US006970675B1

(12) United States Patent
Yoshino et al.

(10) Patent No.: US 6,970,675 B1
(45) Date of Patent: Nov. 29, 2005

(54) IMAGE FORMING APPARATUS AND IMAGE FORMING METHOD

(75) Inventors: Mie Yoshino, Ohta-ku (JP); Tsutomu Sasaki, Ohta-ku (JP)

(73) Assignee: Ricoh Company, Ltd., Tokyo (JP)

( * ) Notice: Subject to any disclaimer, the term of this patent is extended or adjusted under 35 U.S.C. 154(b) by 66 days.

(21) Appl. No.: 10/665,154

(22) Filed: Sep. 22, 2003

(30) Foreign Application Priority Data

Sep. 19, 2002 (JP) ..... 2002-272585
Sep. 20, 2002 (JP) ..... 2002-274653

(51) Int. Cl.[7] ..... G03G 15/16
(52) U.S. Cl. ..... 399/307; 399/308
(58) Field of Search ..... 399/297, 298, 399/299, 302, 308, 307, 233, 237

(56) References Cited

U.S. PATENT DOCUMENTS 5,434,657 A * 7/1995 Berkes et al. ..... 399/308
5,652,080 A 7/1997 Yoshino et al.
5,666,616 A 9/1997 Yoshino et al.
5,923,930 A 7/1999 Tsukamoto et al.
6,038,421 A 3/2000 Yoshino et al.
6,108,508 A 8/2000 Takeuchi et al.
6,154,624 A 11/2000 Sasaki et al.
6,173,147 B1 * 1/2001 Nakashima et al. ..... 399/308
6,405,008 B1 6/2002 Obu et al.
6,466,757 B2 10/2002 Itaya et al.
6,501,932 B2 12/2002 Obu et al.
6,515,747 B1 2/2003 Satoh et al.
6,522,861 B2 * 2/2003 Tokutake et al. ..... 399/401
6,594,463 B2 * 7/2003 Watanabe ..... 399/302
6,636,716 B2 10/2003 Yoshino
6,640,073 B2 10/2003 Kurotori et al.

FOREIGN PATENT DOCUMENTS

JP 11-167295 6/1999
JP 2000-275988 10/2000
JP 2001-337572 12/2001

* cited by examiner

*Primary Examiner*—Hoan Tran
(74) *Attorney, Agent, or Firm*—Oblon, Spivak, McClelland, Maier & Neustadt, P.C.

(57) ABSTRACT

A liquid type image forming apparatus includes a latent image carrier for carrying a latent image, a developing device for developing the latent image on the latent image carrier into a visualized image by a liquid developer containing a toner in a carrier liquid, and a transfer device for electrostatically transferring the visualized image on a recording body after the visualized image on the latent image carrier is intermediately transferred onto an intermediate transfer body. A fluorine compound is coated on at least a surface of the intermediate transfer body. The liquid type image forming apparatus is provided with a heating device for heating the intermediate transfer body.

23 Claims, 10 Drawing Sheets

IMAGE FORMING APPARATUS AND IMAGE FORMING METHOD

BACKGROUND OF THE INVENTION

1. Field of the Invention

The present invention relates to an image forming apparatus and an image forming method in which after a latent image on a latent image carrier is developed by liquid developer, an obtained visualized image is electrostatically transferred on a recording body through an intermediate transfer body.

2. Description of the Prior Art

Conventionally, a liquid type image forming apparatus which utilizes liquid developer containing a toner and carrier liquid for a development of a latent image has been well known. This liquid type image forming apparatus can utilize a far smaller diameter of a toner compared to a dry type image forming apparatus which conducts a development by a powered toner, so that the liquid type image forming apparatus can form an image which has an excellent reproducibility of dots and a high resolution.

In recent years, an improved liquid type image forming apparatus has been proposed. In the improved liquid type image forming apparatus, the visualized image which is developed on the latent image carrier is not directly transferred onto the recording body such as a transfer paper or the like. The visualized image is first transferred onto the intermediate transfer body, and then the image is retransferred to the recording body (For instance, Japanese Patent Laid-Open 2001-337572). This liquid type image forming apparatus causes the intermediate transfer body such as an intermediate transfer belt or the like to closely fit with the recording body with deforming the intermediate transfer body flexibly in accordance with a delicate irregularity on the surface of the recording body. Therefore, the visualized image can be transferred onto a recording body which has a rough surface such as a heavy paper or the like. It is also possible to form a full-color image by transferring an overlapped visualized image, which has a different color each other, on the intermediate transfer body.

Moreover, a liquid type image forming apparatus which includes a heating device for heating the intermediate transfer body is described in Japanese Patent Laid-Open Hei11-167295.

However, this heating device heats the intermediate transfer body in order to heat transfer the toner image on the transfer body from the intermediate transfer body. The device is not for heating the intermediate transfer body by a different purpose of transferring with an electrostatic transfer method which does not require the heating of the intermediate transfer body.

Conventionally, an image forming apparatus, which adopts a transfer device for secondly transferring the image on the intermediate transfer body onto a transfer material such as a paper for transferring or the like after the image on the latent image carrier is primarily transferred on the intermediate transfer body by utilizing the intermediate transfer body, has been known. The transfer device, which utilizes this intermediate transfer body, has been widely used for a color image forming apparatus. In the color image forming apparatus, several color images which are formed for each color component on the latent image carrier are transferred sequentially on the intermediate transfer body with overlapping the images, and then the overlapped image is transferred together on the transfer paper so as to form the color image. The transfer device which utilizes the intermediate transfer device has an advantage which can form the color image stably on the varied transfer materials including the heavy paper. Furthermore, if an elastic material is used as the intermediate transfer body, it is advantageous for a transfer material, which has a rough surface, to obtain a fine transfer performance.

As a developing device which forms the image on the latent image carrier, a developing device which utilizes a solid developer and a developing device which utilizes liquid developer have been widely known. In the developing device which utilizes the solid developer, an electrostatic latent image is developed on the latent image carrier by a coloring powder of the developing device so as to form a powdered image on the latent image carrier. However, when this powdered image is transferred by the transfer device having the intermediate transfer body, there is a problem that a filming is generated on the intermediate transfer body by the component of the powdered image. Therefore in Japanese Patent Laid-Open 2000-275988, the present inventor proposes a color image forming apparatus in which a process for primarily transferring the powdered image onto the intermediate transfer body is performed at plural times in accordance with the number of necessary colors, and secondary transfer is performed for making a transfer medium abut by a secondary transfer roller in accordance with a powdered image on the intermediate transfer body after the powder image is formed on the intermediate transfer body and transferring the powder image from the intermediate transfer body to the transfer medium. In this case, it possesses a removing mode to remove a foreign matter stacked to the intermediate transfer body, and a secondary transfer roller and the intermediate transfer body are slid at circumferential speed different from that of the secondary transfer roller when the secondary transfer to transfer the powder image from the intermediate transfer body to the transfer medium is executed at the time of operation in the removing mode.

On the other hand, the developing device which utilizes the liquid developer is advantageous for obtaining a sharp image because the diameter of the toner is smaller compared to the device which utilizes the solid developer. Therefore the use of the liquid developer has been reconsidered in the recent years. The liquid developer is generally a developer in which a toner having a major component of coloring agent made of carbon black, organic pigment, or dye and binding agent made of resin is dispersed into the carrier liquid having a major component of solvent of a high insulation performance and a low dielectric constant.

As mentioned above, the liquid type image forming apparatus which includes the intermediate transfer body, the visualized image can be transferred onto the recording body having the rough surface such as the heavy paper or the like.

However, in this liquid type image forming apparatus, the following problems have been left. In other word, in a developing position where the latent image carrier and the developer carrier of the developing device face each other, a thin layer of the liquid developer carried by the developer carrier develops the latent image in such a manner that the toner in the liquid developer is migrated toward the latent image, and the toner is gathered. The liquid developer which constructs the visualized image after developing includes a large amount of the toner which is gathered as the above mentioned, while severely decreases a ratio of the carrier liquid compared to before developing because a large amount of the carrier liquid is left in the developer carrier of the developing device. In case of a transfer method utilizing the intermediate transfer body, the ratio of the carrier liquid is decreased when the visualized image is transferred from the latent image carrier to the intermediate transfer body. This visualized image decreases the migration performance of the toner because of reasons in which the toner becomes hard to maintain the electric charge. Therefore, the electrostatically transferring from the intermediate transfer body to the recording body becomes difficult, and then a transfer failure is easy to be generated. This transfer failure is further prominently generated by using the liquid developer of a high viscosity and a high concentration (Toner having a concentration of about 5 to 40 [wt %] is contained in the carrier liquid, and the viscosity is about 50 to 5000 [mPa·s] in which the present inventor is developed. Moreover, the transfer failure is prominently generated without adopting a process, which applies pre-wet liquid on the latent image carrier before developing. In order to control the adhesion of the toner onto a non-image portion i.e. a stain of the surface, adopting an arrangement for sweeping the adhered toner contributes to generate the transfer failure prominently because the carrier liquid in the visualized image is absolutely adhered to the electrostatic member. The arrangement for sweeping the adhered toner is to sweep the toner which is adhered onto the non-image portion by contacting the electrostatic member such as a sweep roller or the like to the latent image carrier after developing and before transferring.

In order to prevent the above mentioned transfer failure, it is possible to improve releaseablity between the toner and the intermediate transfer body by providing a surface layer which decreases a friction resistance by containing a fluorine compound.

However, generally the intermediate transfer body is pressed strongly by the latent image carrier to transfer the visualized image, and the intermediate transfer body tends to strongly hold down a cleaning member (for example, a blade) to clean residual developer of transferring. Therefore, even thought the intermediate transfer body includes the surface layer which has excellent releaseability to the toner, the releaseability to the toner is decreased by deteriorating the surface layer gradually. Consequently it has been difficult to prevent the transfer failure for a time.

On the other hand, as mentioned above, in the development device which utilizes the liquid developer, the development is carried out in such a manner that the toner having the electric charge is moved electrostatically in the carrier liquid in the developing portion where the liquid developer carrier carrying the liquid developer and the latent image carrier face each other. At this point, the carrier liquid is adhered to the latent image carrier side from the developer carrier together with the toner. In the primarily transfer portion where the latent image carrier faces the intermediate transfer body, the transfer is conducted in such a manner that the toner having the electric charge is moved electrostatically in the carrier liquid; however, some of the carrier liquid is transferred to the intermediate transfer body from the latent image carrier together with the toner. In the secondary transfer portion, some of the carrier liquid which is transferred at the primary transfer portion is transferred onto the transfer paper from the intermediate transfer body together with the toner. The image is transferred onto the transfer paper by this process. However, the ratio of the carrier liquid, which is transferred by adhering to the transferring toner, is decreased at the time of the secondary transfer compared to the primary transfer. Therefore the solid content ratio of the toner becomes higher. Furthermore, in the secondary transfer, the transfer member often has a nature to absorb the carrier liquid, so that the ratio in the carrier liquid is further decreased, and the solid content ratio of the toner is further increased.

In the developing device utilizing the liquid developer, it is known that the carrier liquid is pre-wet coated onto the latent image carrier before developing. However, if the pre-wet coating is not carried out, the solid content ratio of the toner on the latent image carrier is decreased, and the solid content ratio of the toner on the intermediate transfer body tends to be increased. When a sweep roller or the like is disposed to decrease the ratio of the carrier liquid on the latent image carrier after developing, the solid content ratio of the toner on the intermediate transfer tends to be increased as well.

When the solid content ratio of the toner is increased by decreasing the ratio of the carrier liquid, the toner becomes hard to be migrated. Moreover, in the liquid developer, if the ratio of the carrier liquid is decreased, the toner becomes difficult to maintain the electric potential, so that the toner becomes hard to be migrated electrostatically. Therefore even though the sufficient transfer performance is obtained in the primary transfer, the transfer performance in the secondary transfer may be decreased. Especially, when the liquid developer of the high viscosity and the high concentration in which the toner is dispersed into the high viscosity of the carrier liquid is used, the migration of the toner becomes harder, and the sufficient transfer performance is hard to be obtained in the secondary transfer.

When the secondary transfer is carried out, the transfer performance is improved in such a manner that the image on the intermediate transfer body and the transfer paper are pressed to closely fit by using a member for pressing the transfer member to the intermediate transfer body such as a transfer roller. Especially, if the high pressure is applied for the transfer member which has a rough surface roughness, the toner is transferred onto the concave portion of the transfer member, so that the transfer performance is improved. At this point, high pressure is applied for improving the transfer performance of the secondary transfer.

However, on the intermediate transfer body, as described above, the solid content ratio of the toner is high, so that the viscosity of the developer is also high. Furthermore, some portion of the resin of the solid content in the liquid developer is swelled in the carrier liquid and has an adherence. Therefore, the developer has the high solid content ratio on the intermediate transfer body, so that the resin in the developer is easy to be adhered to the intermediate transfer body. If the resin in the developer is adhered onto the intermediate transfer body, and the body receives the high pressure in the secondary transfer portion, the resin may be firmly fixed for a long time.

After the secondary transfer, the residual toner and some of the carrier liquid which are not transferred onto the transfer body are adhered to the intermediate transfer body. A cleaning blade as a cleaning device for the intermediate transfer body is disposed, and the residual toner and the carrier liquid are eliminated with sliding the intermediate transfer body by the cleaning blade. However, there may be a case that the resin contained in the liquid developer is adhered to the intermediate transfer body and firmly fixed in the cleaning portion. This is because of the resin contained in the liquid developer is softened by the heat and the friction with the cleaning blade.

Recently, in order to improve the dispersibility of the toner into the carrier liquid, in the using environment, developer that the dispersing agent which is made of liquid resin is added in to the liquid developer is used. In the liquid developer which contains the liquid resin, the resin is easy to be adhered to the intermediate transfer body by its viscosity, and the resin is easy to be firmly fixed onto the intermediate transfer body by the friction and the pressure from the secondary transfer portion or the cleaning portion.

If such substance is firmly fixed on the surface of the intermediate transfer body, the function as the intermediate transfer body is lost. Especially, the releaseability from the intermediate transfer body is deteriorated, and the secondary transfer performance is remarkably lowered. Moreover, the image which is developed by the liquid developer has the high solid content ratio of the toner as described above, so that the secondary transfer performance is lowered compared to the primary transfer. Moreover, if the influence by firmly fixing the substance onto the intermediate transfer body is added, the deterioration of the secondary transfer performance is appeared prominently.

SUMMARY OF THE INVENTION

It is therefore a first object of the present invention is to provide a liquid type image forming apparatus which can control a deterioration of an image caused by a transfer failure from an intermediate transfer body to a recording body for a long time.

Present inventors have heated the intermediate transfer body having a surface layer containing a fluorine compound which deteriorates releaseability of a toner by a usage of a long processing time. Surprisingly, the releseability of the toner on the surface layer could be recovered. This is because the surface layer that the direction of the fluorine compound is disturbed by a nip pressure or a friction with a blade may be recovered to the original direction by heating.

A second purpose of the present invention is to provide an image forming apparatus and a method which can obtain a high quality image with maintaining a fine transfer performance for a long time by preventing an adhesion of a substance on the intermediate transfer body.

In order to achieve the first object, according to a first feature of the present invention, the image forming apparatus is provided. The image forming apparatus includes a latent image carrier for carrying a latent image, a developing device for developing the latent image on the latent image carrier into a visualized image by a liquid developer containing a toner in a liquid carrier, and a transfer device for electrostaically transferring the visualized image on a recording body after the visualized image on the latent image carrier is intermediately transferred onto an intermediate transfer body. The fluorine compound is contained at least a surface of the intermediate transfer body, and a heating device for heating the intermediate transfer body is disposed in the image forming apparatus.

To give a concrete example, the heating device is constructed to heat the intermediate transfer body where is after the visualized image is transferred onto the recording body and is before another visualized image is intermediately transferred from the latent image carrier.

The intermediate transfer body includes an elastic layer which has a material of urethane resin and a surface layer which contains the fluorine compound.

The surface layer and the elastic layer include conductivity.

In one example, the heating device is composed of a heating roller, which is heated from a heat source disposed internally and rotates with contacting to the intermediate transfer body.

In other example, the heating device heats the intermediate transfer body without contacting thereto.

In other example, the heating device makes a heating belt, which is moved endlessly, contact onto the intermediate transfer body with receiving a heat transfer from a heat source.

The heating roller is a pressing roller for pressing a recording body, in which a visualized image is transferred from the intermediate transfer body, toward the intermediate transfer body.

In order to achieve the second purpose, according to a first aspect in a second feature of the present invention, an image forming apparatus is provided. The image forming apparatus includes an image carrier for carrying an electrostatic latent image, a developing device for developing the electrostatic latent image on the image carrier by using a liquid developer which is made of a carrier liquid and a toner containing resin and pigment, a primary transfer device for transferring an image on the latent image carrier onto an intermediate transfer body, a secondary transfer device for transferring an image on the intermediate transfer body onto a transfer member, and a device for eliminating a substance on an intermediate transfer body having a form roller. The substance on the intermediate transfer body is eliminated by rubbing a surface of the intermediate transfer body with the form roller.

An image forming apparatus according to a second aspect of the present invention includes an image carrier for carrying an electrostatic latent image, a developing device for developing the electrostatic latent image on the image carrier by using a liquid developer which is made of a carrier liquid and a toner at least containing resin and pigment, a primary transfer device for transferring an image on the image carrier onto an intermediate transfer body, a secondary transfer device for transferring an image on the intermediate transfer body to a transfer member, and a device for eliminating a substance on an intermediate transfer body having a non-woven fabric. The substance on the intermediate transfer body is eliminated by rubbing a surface of the intermediate transfer body with the non-woven fabric.

An image forming apparatus according to a third aspect of the present invention includes an image carrier for carrying an electrostatic latent image, a developing device for developing the electrostatic latent image on the image carrier by using a liquid developer which is made of a carrier liquid and a toner at least containing resin and pigment, a primary transfer device for transferring an image on the image carrier onto an intermediate transfer body, a secondary transfer device for transferring an image on the intermediate transfer body to a transfer member, a device for eliminating a substance on an intermediate transfer body having a brush roller. The substance on the intermediate transfer body is eliminated by rubbing a surface of the intermediate transfer body with the brush roller.

An image forming apparatus according to a fourth aspect of the present invention includes an image carrier for carrying an electrostatic latent image, a developing device for developing the electrostatic latent image on the image carrier by using a liquid developer which is made of a carrier liquid and a toner at least containing resin and pigment, a primary transfer device for transferring an image on the image carrier onto an intermediate transfer body, a secondary transfer device for transferring an image on the intermediate transfer body to a transfer member, and a device for eliminating a substance on an intermediate transfer body having a metal blade is provided. The substance on the intermediate transfer body is eliminated by rubbing a surface of said intermediate transfer body with the metal blade.

An image forming apparatus according to a fifth aspect of the present invention includes an image carrier for carrying an electrostatic latent image, a developing device for developing the electrostatic latent image on the image carrier by using a liquid developer which is made of a carrier liquid and a toner at least containing resin and pigment, a primary transfer device for transferring an image on the image carrier onto an intermediate transfer body, a secondary transfer device for transferring an image on the intermediate transfer body to a transfer member, and a device for eliminating a substance on an intermediate transfer body having a substance eliminating member, which is harder than the resin composing said toner and is softer than a surface of said intermediate transfer body. The substance on the intermediate transfer body is eliminated by rubbing the surface of the transfer body with the substance eliminating member.

An image forming apparatus according to a sixth aspect of the present invention includes an image carrier for carrying an electrostatic latent image, a developing device for developing the electrostatic latent image on the image carrier by using a liquid developer which is made of a carrier liquid and a toner at least containing resin and pigment, a primary transfer device for transferring an image on the image carrier onto an intermediate transfer body, a secondary transfer device for transferring an image on the intermediate transfer body to a transfer member, and a device for eliminating a substance on an intermediate transfer body having a substance eliminating member which has a rougher surface roughness than a surface of said intermediate transfer body. The substance on the intermediate transfer body is eliminated by rubbing the surface of the intermediate transfer body with the substance eliminating member.

An image forming apparatus according to a seventh aspect of the present invention includes an image carrier for carrying an electrostatic latent image, a developing device for developing the electrostatic latent image on the image carrier by using a liquid developer which is made of a carrier liquid and a toner at least containing resin and pigment, a primary transfer device for transferring an image on the image carrier onto an intermediate transfer body, a secondary transfer device for transferring an image on the intermediate transfer body to a transfer member, and a device for eliminating a substance on an intermediate transfer body which sprays a high temperature vapor to said intermediate transfer body.

To give a concrete example, the device for eliminating the substance on the intermediate transfer body is provided with a mechanism for cooling an intermediate transfer body for cooling at least the surface of the intermediate transfer body.

The device for eliminating the substance on the intermediate transfer body is provided with a heating mechanism of an intermediate transfer body for heating at least the surface of said intermediate transfer body.

The device for eliminating the substance on the intermediate transfer body is provided with a solvent coating mechanism for dissolving the resin composing the toner and for adhering a solvent which does not dissolves the surface of the intermediate transfer body to the surface of the intermediate transfer body.

A cleaning member is disposed in a downstream of the device for eliminating the substance on the intermediate transfer body with respect to a rotation direction of the intermediate transfer body.

The liquid developer contains liquid type resin in a using environment.

In one example, a substance elimination on the intermediate transfer body by the device for eliminating the substance on the intermediate transfer body is carried out when an image is formed. In other example, a substance elimination on the intermediate transfer body by the device for eliminating the substance on the intermediate transfer body is carried out when an image is not formed.

The substance elimination on the intermediate transfer body by the device for eliminating the substance on the intermediate transfer body is carried out at regular time intervals.

The substance elimination on the intermediate transfer body by the device for eliminating the substance on the intermediate transfer body is carried out every a predetermined number of print.

The several devices for eliminating the substance on the intermediate transfer body are combined to use.

An image forming method according to a eight aspect of the present invention includes the methods of primary transferring an image on an image carrier, which is developed by using a liquid developer containing a liquid type resin in a using environment, onto an intermediate transferring device, secondary transferring an image on the intermediate transfer body onto a transfer member, and eliminating a substance on the intermediate transfer body.

In the above mentioned image forming apparatus and the image forming method, if the substance generated by the resin of the toner in the liquid developer or the like is adhered onto the surface of the intermediate transfer body, the substance can be eliminated by the device for eliminating the substance on the intermediate transfer body. The device for eliminating the substance on the intermediate transfer body sweeps the substance away by the member which rubs the surface of the intermediate transfer body, and rakes the substance by floating the substance with heat and pressure. The substance can be thereby eliminated. Therefore even though, the substance is adhered to the surface of the intermediate transfer body, the substance is not firmly fixed onto the surface of the intermediate transfer body. When the liquid developer is used, an efficiency of the intermediate transfer body is maintained. A high quality image can be obtained by keeping a fine transfer performance for a long time.

DETAILED DESCRIPTION OF THE PREFERRED EMBODIMENTS

In a liquid type printer of an electro-photography process (hereinafter referred to as a printer), which is adopted as an image forming apparatus according to a first aspect of the present invention, a first embodiment in which an image is formed by a reversal developing will be explained below referring to accompanying views.

Figure 1:
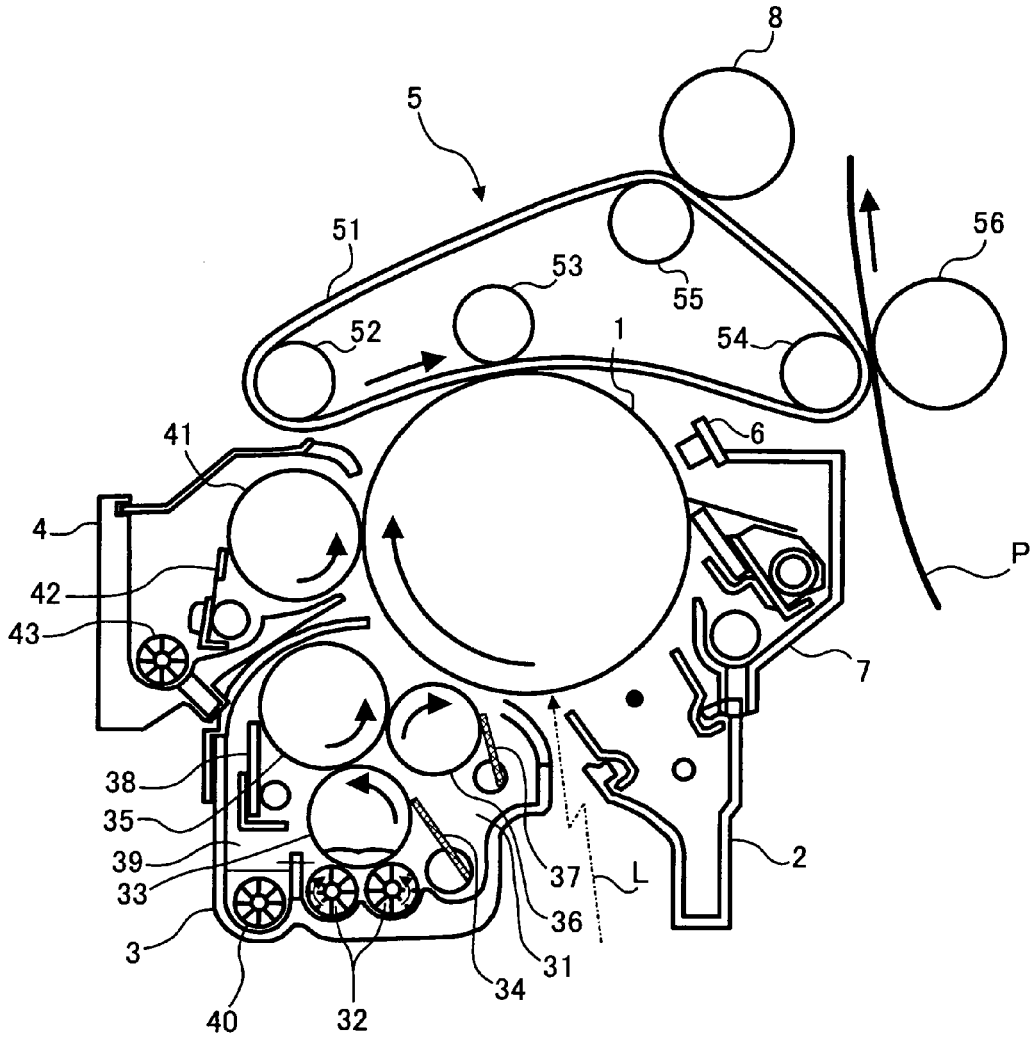
FIG. 1 is a schematic structural view showing a relevant part of a first embodiment of a printer in which an image forming apparatus according to a first feature of the present invention is disposed.

A basic arrangement of the printer according to the embodiment will be described. As shown in FIG. 1, this printer comprises a photoconductor drum 1 of a latent image carrier. This printer further comprises an electrification unit 2 and a developing unit 3, a sweep device 4, a transfer device 5 of a transfer device, a discharge lamp 6, a drum cleaning device 7 and so on. These are arranged around the photoconductor drum 1. This printer also comprises an exposure device which is disposed in an area (not shown).

The surface of the above mentioned photoconductor 1 is formed by amorphous silicone (a—Si), and the photoconductor 1 is rotated in the clockwise direction as shown in the view by a driving device (not shown) at a predetermined speed when an image is printed. The photoconductor is uniformly charged to for example 600 [V] in a dark by a corona discharge from the electrification unit 2. The above mentioned exposure device is equipped with a scanning optical system, and the uniformly charged surface of the photoconductor 1 is exposed by a LED beam and a laser beam based on image information.

In the exposed portion of the photoconductor 1, an electrical potential is decreased, and the portion becomes for example an electrostatic latent image of below 50 [V]. This electrostatic latent image is developed as a toner image which is a visualized image by the developing unit 3 using liquid developer which contains a toner in carrier liquid. An organic photoconductor (OPC) can also be used as the photoconductor 1.

Besides using the method for achieving the electrification by the corona discharge as shown in the view, the electrification unit 2 can also use a method for applying predetermined electrification bias onto an electrification member such as an electrification roller, or the like which is contacted to the photoconductor 1.

The above mentioned transfer device 5 comprises an intermediate transfer belt 51 of an intermediate transfer body, a tension roller 52, a primary transfer bias roller 53, a secondary transfer backup roller 54, a heating backup roller 55, a secondary bias roller 56 and so on. These four rollers except the secondary transfer bias roller 56 are wound by the intermediate transfer belt 51, and the belt is moved endlessly in the counterclockwise direction as shown in the view by the rotation of at least one of the four rollers.

The primary transfer bias roller 53 presses the intermediate transfer belt 51 from the back side of the belt (an inside of a belt loop) toward the photoconductor 1 with receiving a supply of the primary transfer bias from an electric source (not shown). The pressed intermediate transfer belt 51 forms a primary transfer nip by contacting to the photoconductor 1. In this primary transfer nip, a primary transfer electric field is formed by an electric potential difference between the primary transfer bias roller 53 in which the above primary transfer bias is applied and the surface of the photoconductor 1. The toner image which is entered to the primary transfer nip with the rotation of the photoconductor 1 is primary transferred electrostatically onto the intermediate transfer belt 51 by receiving an action of the nip pressure or this primary transfer electric field.

Besides the method for achieving the primary transfer by this primary transfer bias roller 53, a method for achieving the primary transfer by corona discharge can be adopted as the transfer device 5.

In the intermediate transfer belt 51, the secondary bias roller 56 is come into contact with the surface of the portion in which the secondary transfer backup roller 54 is wound by the belt. In a secondary transfer nip which is formed by this contact, a secondary transfer electric field is formed by an electric potential difference between the secondary transfer bias roller 56 in which the secondary transfer bias is applied from an electric source (not shown) and the secondary transfer backup roller 54.

The printer is equipped with a paper feeding cassette and a pair of resist rollers in an area (not shown). This paper feeding cassette feeds a transfer paper which is contained in the cassette with a predetermined timing toward the pair of the resist rollers. After the pair of the resist rollers sandwiches the transfer paper, which is fed from the paper feeding cassette, between the rollers, the rollers feed the paper toward the secondary transfer nip with a precise timing. Therefore, in the secondary transfer nip, a transfer paper P of a recording body is closely fitted to the toner image on the intermediate transfer belt 51.

The toner image on the intermediate transfer belt 51 is secondary transferred electrostatically onto the transfer paper P by receiving an influence of the nip pressure or the secondary transfer bias at the secondary transfer nip. After the transfer paper P in which the toner image is transferred is went out the secondary transfer nip with the endless movement of the intermediate transfer belt 51 and the rotation of the secondary transfer bias roller 56, the paper is fed to a fixing device (not shown). In this fixing device, after fixing processing of the toner image is conducted by a method for heating and pressing, a method for using a solvent, an UV method and so on, the paper is ejected to an outside of the apparatus through an ejection path (not shown).

In the photoconductor 1 in which the primary transfer nip is passed, after residual electric on the surface is discharged by the discharge lamp 6, residual liquid developer of the transfer which is adhered to the surface of the photoconductor 1 is cleaned by the drum cleaning device 7. The surface of the photoconductor 1 is initialized by this cleaning and is prepared for forming a next image.

The developing device 3 comprises a tank portion 31, two agitation screws 32, an anilox roller 33, a doctor blade 34, a developing roller 35, a roller for thinning a layer 36, a first cleaning blade 37, a second cleaning blade 38, and so on. The developing device 3 also comprises a feedback portion 39, a return screw 40 and so on.

The developing unit 3 rotates around an axis as the center (not shown), and when the image is formed, the developing roller 35 is come into the contact with the photoconductor 1 through the developer layer.

The liquid developer containing a high concentration of the toner which is charged positively in the carrier liquid is stored in the tank portion 31. This liquid developer is not a developer of a low viscosity and a low concentration, which has been widely used in the prior art, and it is a developer of a high viscosity and a high concentration. At this point, the liquid developer of the low viscosity and the low concentration is the developer of about 1 [cSt] in the viscosity, for example so called Isopar (Registered Trade Mark), which has been widely used in a market, containing about 1 [wt %] of the toner in an insulator carrier liquid. On the other hand, the liquid developer of the high viscosity and the high concentration contains the high concentration of the toner in an insulator carrier liquid for example silicone oil, normalparaffin, IsoparM (Registered Trade Mark), vegetable oil, mineral oil or the like. In particularly, the developer contains about 5 to 40 [wt %] of the toner, and its viscosity is about 50 to 5000 [mPa·s].

A volatile or an involtaile of the liquid developer of the high viscosity and the high concentration is adjusted in accordance with a developing characteristic of the developing unit 3, an image forming characteristic of the printer and so on. The particle diameter of the toner in the liquid developer is also adjusted within a range form submicron to 6 [$\mu$m] in accordance with the developing characteristic, the image forming characteristic and so on.

The two agitation screws 32 are disposed parallel so as to soak into the liquid developer in the tank portion 31, and as showing the arrow in the view, the screws are rotated in an opposite direction each other by a driving device (not shown). When the developing unit 3 starts the developing operation, the two agitation screws 32 are rotated in the opposite direction each other, and the liquid developer in the tank portion 31 is agitated. Thereby the toner concentration and the toner viscosity of the liquid developer are uniformed. In accordance with the rotation of the two agitation rollers in the opposite direction each other, the liquid level of the liquid developer is increased between the two rollers shown in the view, and the liquid developer is adhered to the anilox roller 33 which is disposed in the upside of the two screws.

The anilox roller 33 pumps the liquid developer in the tank portion 31 with rotating in the counterclockwise direction as shown in the view by the driving device (not shown). However, the rotation direction of the anilox roller 33 is not only the counterclockwise direction as shown in the view. In the surface of the anilox roller 33, a groove pattern of a spiral (not shown) is carved with a fineness of for example 100 to 200 [1 pi]. In the groove pattern, several fine concave portions are formed to line in the direction of the groove. Some of the liquid developer pumped by the anilox roller 33 is contained in these fine concave portions.

The doctor blade 34 is formed by metal such as stainless-still or the like. However, the doctor blade 34 is not always required to be disposed. The doctor blade 34 controls the amount of the liquid developer on the anilox roller 33 by contacting to the rotating anilox roller 33. The amount of the liquid developer carried onto the anilox roller 33 is precisely measured in accordance with the capacity of the above mentioned fine concave portion by this controlling.

The developing roller 35, with contacting to the surface of the anilox roller 33 in which the amount of the liquid developer is controlled, is rotated and is driven in the counterclockwise as shown in the view as moving the surface in the opposite direction of the anilox roller 33 at the contacting portion. The liquid developer which is measured precisely on the anilox roller 33 is applied to the developing roller 35 with a uniform thickness. A thin layer of the developer with the uniform thickness which is made of the liquid developer is formed onto the developing roller 35 by this applying, and the thin layer is transported to the contacting portion between the developing roller 35 and the roller for thinning the layer 36. In this contacting portion, the surface of the thinning layer roller 36 and the developing roller 35 are moved at the same liner velocity and the same direction, and the thickness of the thin layer of the developer is further decreased by transferring some of the thin layer of the developer to the thinning layer roller 36.

The surface of the developing roller 35 is equipped with a conductive elastic layer which is made of conductive polyurethane rubber or the like, and the developing roller 35 forms a developing nip by contacting to the photoconductor 1 with rotating at the same speed as the photoconductor 1. The developing bias is also applied to the developing roller 35 from an electric source path of the developing bias (not shown). This developing bias has the same positive electrode has the electrification electrode of the toner, and is set to a smaller value (for example 500V) than the uniformly charged electrical potential of the photoconductor 1. In the developing nip, the developing roller 35, a naked portion (non-exposed portion) of the photoconductor 1 and the electrostatic latent image respectively have the electrical potential of the same electrode as the electrode of the toner. The amount of the electrical potential becomes smaller in order of the naked portion, the developing roller 35, and the electrostatic latent image (600V, 500V, 50V). Therefore, in the portion between the naked portion and the developing roller 35, non-developing potential is operated in such a manner that the toner is moved electrostatically toward the developing roller 35 which has the smaller electrical potential than that of the electrical potential of the naked portion (600V→500V). Moreover, in the portion between the developing roller 35 and the electrostatic latent image, the developing potential is operated in such a manner that the toner is moved toward the electrostatic latent image having the lower electrical potential than that of the developing roller 35 (50V→500V). Therefore, in the developing nip, the toner contained in the thin layer of the developer is migrated electrically toward the surface of the developing roller 35 in the portion between the developing roller 35 and the naked portion, and is gathered on the surface. On the other hand, the toner contained in the thin layer of the developer is migrated electrically toward the electrostatic latent image in the portion between the developing roller 35 and the electrostatic latent image, and is adhered to the electrostatic latent image. Then the electrostatic latent image is thereby developed, and becomes the toner image.

It is also possible to have a difference in the potential between the developing roller 35 and the roller for the thinning the layer 36. By the difference in the potential, some of the toner on the developing roller on can be eliminated. The toner on the developing roller is pressed to the developing roller side without eliminating the toner on the developing roller, and some of the carrier liquid is also eliminated.

The first cleaning blade 37 is composed of a material such as metal, rubber or the like, and is disposed to contact to the roller for thinning the layer 36. The cleaning blade 37 sweeps the liquid developer away from the roller for thinning the layer 36 in which some of the thin layer of the developer is transferred from the developing roller 35. The swept liquid developer is returned to the tank portion 31. The second cleaning blade 38 is composed of a material such as metal, rubber or the like, and is disposed to contact to the developing roller 35. However, the second cleaning blade is not always required. The second cleaning blade 38 sweeps the liquid developer away from the developing roller 35 which is passed the developing nip. The swept liquid developer falls into the feedback portion 39 in the developing unit 3, and the liquid developer is returned to a developer adjusting portion (not shown) by the return screw 40. This developer adjusting portion has a role to return the returned liquid developer to the tank portion 31 in the developing unit 3 after the concentration of the toner is restored by applying the carrier liquid and the toner into the returned liquid developer.

In the developing nip, the toner which is positioned between the developing roller 35 and the naked portion of the photoconductor 1 is not basically adhered to the naked portion of the photoconductor 1 because the toner is migrated electrically toward the surface of the developing roller 35 and is gathered on the surface. However, after the toner is normally migrated electronically, if some of the toner which has a smaller electrification amount than a normal electrification amount is migrated electronically, there may be a case that the toner is adhered to the naked portion and causes so called a stain of a surface (fogging toner). The sweep device 4 has a role to clean the fogging toner, which causes the stain of the surface, from the photoconductor 1. In particularly, the sweep device 4 is equipped with a sweep roller 41 which rotates with contacting to the photoconductor 1, and the sweep roller 41 is positioned in further downstream side of the rotating direction of the drum than the developing nip.

The surface of this sweep roller 41 is provided with a conductive elastic layer which is made of conductive urethane rubber or the like, and the sweep roller 41 forms a cleaning nip by contacting to the photoconductor 1 with rotating at the same speed as the photoconductor 1. Cleaning bias which has the same electrode as the electrode of the electrification of the toner is applied to the sweep roller 41 by the electric source (not shown). In the cleaning nip, the sweep roller 41, the naked portion, and the electrostatic latent image respectively have the electrical potential of the same electrode as the electrode of the toner. The value of the electrical potential is decreased in the order of the naked portion, the sweep roller 41, and the electrostatic latent image. Therefore, the fogging toner which is not gathered on the surface of the developing roller 35 in the developing nip is electrically migrated toward the sweep roller 41 in the portion between the naked portion and the sweep roller 41, and the fogging toner is eliminated from the naked portion. After the carrier liquid and the toner which are adhered to the sweep roller 41 in the cleaning nip are swept away by the cleaning blade 42, the carrier liquid and the toner are sent to the developer adjusting portion. In the developing unit 3 or the sweep device 4, other cleaning method such as a roller type method can be adopted instead of using the cleaning blade.

Figure 2:
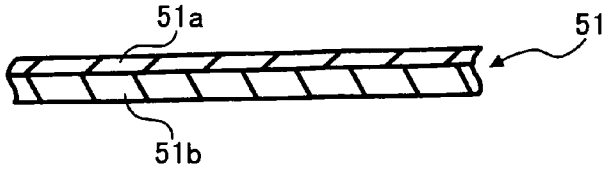
FIG. 2 is an enlarged cross section view showing an intermediate transfer belt of the printer in FIG. 1.

FIG. 2 is the enlarged cross section view showing the intermediate transfer belt 51. The intermediate transfer belt 51 comprises a conductive elastic layer 51*b* and a surface layer 51*a* which is coated on the surface of the elastic layer. The elastic layer is the layer in which carbon black is dispersed in polyurethane resin. The layer brings out the conductivity of the volume resistivity of which is about $10^7$ to $10^{12}$ [Ω·cm], and the thickness of the layer is about 2.5 [mm]. If the conductivity is the above mentioned degree, an electrical potential record influenced by the secondary transfer bias or the surface electric potential of the photoconductor is hardly remained on the intermediate transfer belt. The primary transfer bias which is applied through the primary transfer bias roller 53 can be conveyed sufficiently to the inside of the belt. It is desirable for the hardness of the conductive layer 51*b* to be adjusted to 25 to 60 [°] in JIS A hardness. The surface layer 51*a* is the layer in which fluorine compound for improving the releaseablility of the toner by decreasing the surface energy is dispersed in polyurethane resin. As the fluorine compound, polyfluorovinyl, polyfluorovinylidene, polytrifluoroethylene, polytetrafluoroethylene, and so on are used. A conductive material such as carbon black to bring out the conductivity is also dispersed in the surface layer 51*a*. A method for coating the elastic layer 51*b* of the surface layer 51*a* includes a method in which softening resin is coated by a spray coating, a dip coating, a ring coating, and so on. It is desirable for the thickness of the surface layer 51*a* to be adjusted to below the average particle diameter of the toner (below 1 μm).

As the material of the elastic layer 51*b*, besides the urethane resin, varied elastic materials such as polyimide, polyamideimide or the like is used. Other elastic material such as fluorosilicone rubber or non-elastic material is also used as the material of the surface layer 51*a*. However, it is desirable for the both layers to use the material which is not swelled in the carrier liquid and the material in which oil element of the inside is not permeated. Especially, when the silicone type oil is used as the carrier liquid, it is not desirable to use the silicone type resin as the material of each layer because the layer is swelled by absorbing the oil. Based on the above-mentioned point, in the present invention, the urethane resin is used as the material for the each layer.

The secondary transfer bias roller 56 is the layer in which an elastic surface layer is coated on a surface of a metal core. The elastic surface layer brings out the conductivity of the volume resistivity of which is about $10^3$ to $10^{12}$ [Ω·cm]. If the volume resistivity of the elastic surface layer is lower than $10^3$ [Ωcm], leaking is caused in the portion between the secondary transfer bias roller and the intermediate transfer belt 51 which is through a non image portion, and a secondary transfer electric field is hard to be formed. Therefore, the secondly transfer performance is greatly decreased. Moreover, if the volume resistivity is higher than $10^{12}$ [Ω·cm], the formation of the secondary transfer electric field is disturbed, and the stable transfer performance is hardly achieved because of the transfer performance is largely changed by an electrical resistance change caused by an environmental change and so on. A surface made of polyimide, tetrafluoroethylene.perfluoroalkylvinylether copolymer resin (PFA), or the like, which is superior to abilities such as a smoothness of the surface, a heat resistance, and a chemical resistance, may be coated on the elastic surface layer. Generally in an elastic material which has a low hardness, the surface of the material tends to be rough. Therefore, it is hard for the roller to have the both smoothness of the surface and the excellent elasticity. However, the adhesion of the toner can be controlled by the excellent smoothness of the surface, which is further coated on the elastic surface layer with bringing out the excellent elasticity as the whole roller.

When the intermediate transfer body which is faced to the secondary transfer bias roller includes the elasticity, a metal roller or a roller without having the elasticity can be used as the secondary transfer bias roller.

The characteristic arrangement of the printer will be explained below.

As shown in the FIG. 1, a heating roller 8 as a heating device is contacted on the surface of the intermediate belt 51 in the transfer device 5, and is rotated with the belt. The belt portion in which the heating roller 8 is contacted is the portion where the heating backup roller 55 is wound, and it is also the portion after passing through the secondary transfer nip and before entering the primary transfer nip. The heating roller 8 comprises a heat source such as a heater or the like inside, and the heat emitted by this heater heats the intermediate transfer belt 51. In the heated intermediate transfer belt 51, an increase in the surface energy of the surface layer 51*a*, which is caused by a pressure received at each transfer nip and a friction with a belt cleaning device (not shown), is controlled. An excellent toner releaseability of the surface layer 51*b* is thereby maintained for long operating hours. This is because, even though the direction of the fluorine compound in the surface layer 51*b* is changed by the pressure and the friction, the direction changed by the heating is back to the direction before the direction is changed. It is possible to use the heating roller that the heat source is contained in the aluminum and copper having good heat conductivity as the heating roller 8. It is desirable for a heating temperature to the intermediate transfer belt 51 to be a range from 50 to 140 [°C]. A method for controlling the heating temperature within this range is conducted in such a manner that a sensor is provided to detect the belt surface temperature in the downstream side of the contact portion of the heating roller, and the heat source is turned on or is turned off so as that the result detected by this sensor becomes within the above mentioned range.

As described above, the heating roller 8 is rotated with the endless movement of the intermediate transfer belt 51. Therefore, the friction between the heating roller 8 and the intermediate belt 51 is not caused, and also the deterioration of the toner releaseability caused by the friction can be avoidable.

The heating roller 8 is disposed to heat the portion of the intermediate transfer belt 51 where is the portion after passing through the secondary nip portion and also the portion before entering through the primary nip portion. In this arrangement of the heating roller 8, it is possible to avoid that the toner image on the intermediate transfer belt 51 is disturbed by contacting to the heating roller 8. It is also possible to avoid a transferring failure caused by in such a manner that the toner on the intermediate transfer belt 51 is softened by the heating, and the electric charge of the toner is decreased.

It is desirable for the intermediate transfer belt 51 to be composed of a material, which is inferior to a warmth retaining property, a heat conductance, and has a low specific heat, in terms of a needlessness of conducting the heat to the toner image which is carried by the belt. It also is desirable to use a heat resistance material so as to control deterioration caused by the heating.

Figure 3:
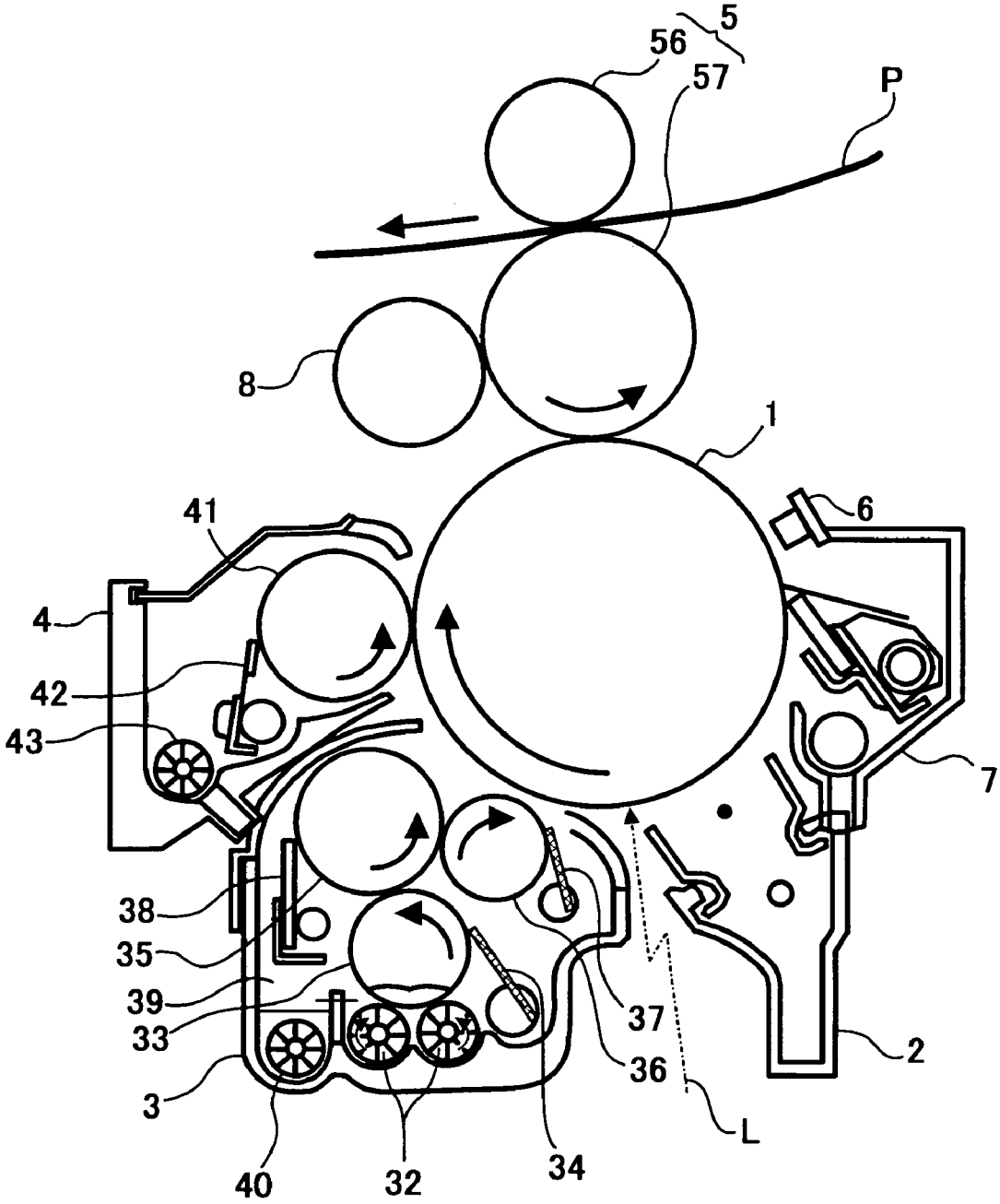
FIG. 3 is a schematic structural view showing a relevant part of a modification example device of the printer in FIG. 1.
Figure 4:
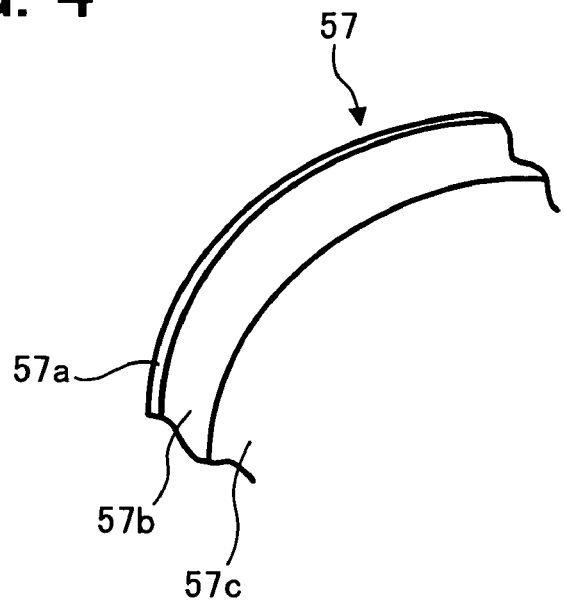
FIG. 4 is an enlarged structural view showing partly an intermediate transfer roller of a printer according to the first embodiment.

FIG. 3 is a schematic structural view showing a relevant part of a modification example of a printer according to the embodiment. This modification example device is equipped with a intermediate transfer roller 57 as a transfer device 5 instead of the intermediate transfer belt 51. As shown in FIG. 4, the intermediate transfer roller 57 is the roller which is coated a substrate 57*c* made of a metal such as aluminum or the like with an elastic layer 57*b* and a surface layer 57*a*. The same materials which are used for the intermediate transfer belt 51 are used as materials for these two layers of the elastic 57*b* and the surface 57*a*. In the metal substrate 57*c*, primary transfer bias is applied. As a whole, the intermediate transfer roller 57 brings out the hardness of the degree which can apply a sufficient pressure on the toner image at the primary transfer nip and the secondary transfer nip. The modification example device of the arrangement can simplify the arrangement of the transfer device 5 compared with the device utilizing the belt as the intermediate transfer body. The heating roller 8 is positioned to heat the surface of the intermediate transfer roller 57 which is after passing through the secondary transfer nip and also before entering the primary transfer nip as same as the arrangement of the printer according to the embodiment.

The printer of each embodiment in which the more characteristic arrangement is added to this modification example device will be explained below.

First Embodiment

Figure 5:
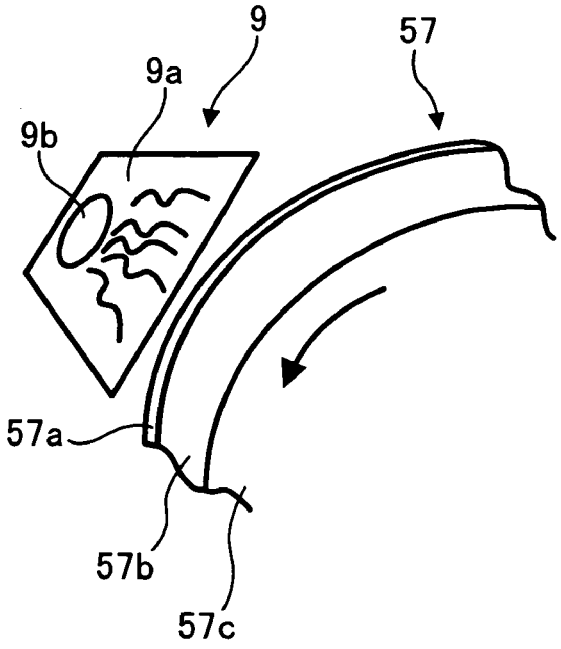
FIG. 5 is an enlarged structural view showing one part of the intermediate transfer roller of the printer in FIG. 1 and a noncontact type heating unit for heating the roller.

FIG. 5 is an enlarged structural view according to the first embodiment of the printer showing one portion of the intermediate transfer roller 57 and a noncontact heating unit 9 for heating the roller. The printer is equipped with the noncontact heating unit 9 as a heating device for heating the intermediate transfer roller 57. The nonconatct heating unit 9 is disposed facing to the intermediate transfer roller 57 with a predetermined space. The noncontact heating unit 9 includes a halogen lamp, a far-infrared halogen heater, a heat source 9*b* such as a heating wire or the like on a platy base 9*a*. The noncontact heating unit 9 heats the intermediate transfer roller 57 by conducting radiation heat from the heat source to the intermediate transfer roller 57. The surface of the base 9*a* which is faced to the intermediate transfer roller 57 is a mirror surface finished. The heat from the heat source 9*a* and the reflected heat from the intermediate transfer roller 57 are thereby effectively reflected toward the intermediate transfer roller 57. In the printer according to the arrangement, the intermediate transfer roller 57 is heated with the noncontact state; therefore, the deterioration of the toner releaseability of the intermediate transfer roller 57 caused by pressing the intermediate transfer roller 57 with the heating device. A device for cleaning the heating device is not required because the toner and the carrier liquid on the intermediate transfer roller 57 are not adhered to the noncontact heating unit 9.

Second Embodiment

Figure 6:
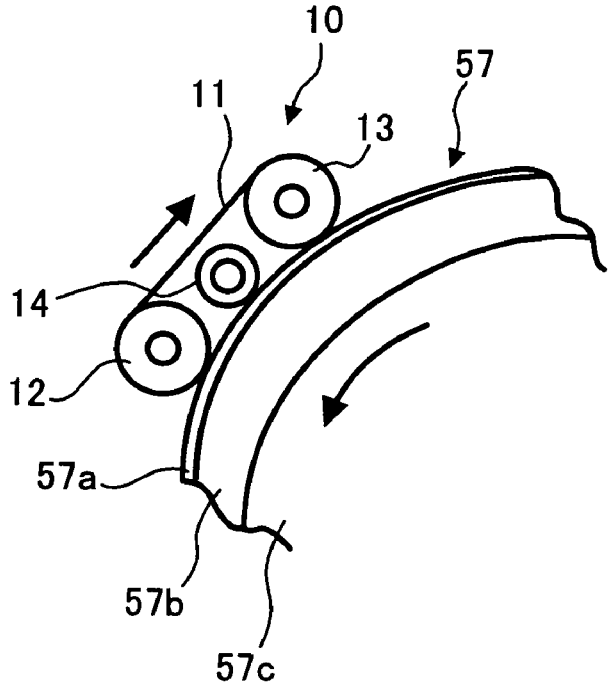
FIG. 6 is an enlarged structural view showing one part of the intermediate transfer roller of the printer according to a second embodiment and a heating belt unit for heating the roller.
Figure 7:
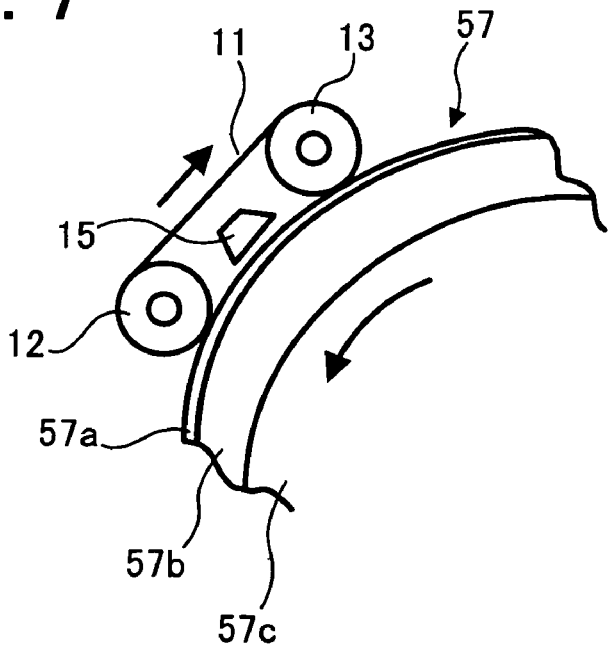
FIG. 7 is an enlarged structural view showing one part of the intermediate transfer roller for a modification example of the printer shown in FIG. 6, and a heating belt unit for heating the roller.

FIG. 6 is the enlarged structural view of the printer according to the second embodiment showing one portion of the intermediate transfer roller 57 and a heating belt unit for heating the roller. The printer is equipped with a heating belt unit 10 as a heating device for heating the intermediate transfer roller 57. The heating belt unit 10 includes a heating belt 11 which is composed of a heat resistance material, a driven roller 12 which is wound by the belt, a driving roller 13, a heating roller 14 and so on. The heating belt 11 is moved endlessly in the clockwise direction shown in the view at the same linear velocity with the intermediate transfer roller 57 so as to move on the surface of the roller toward the same direction with the intermediate transfer roller 57 by driving of the driving roller 13 at the contacted portion with contacting to the intermediate transfer roller 57. The heat roller 14 which includes the heat source inside is contacted onto the backside of the heating belt 11 (inside of the belt loop). After the heating belt 11 is heated from the backside of the belt by contacting to this heating roller 14 in the process of moving endlessly, the heating belts heats the intermediate transfer roller 57 by contacting thereto. In the arrangement of the heating belt unit 6, a long heating nip can be formed in such a manner that the heating belt 11 is contacted flexibly onto the intermediate transfer roller 57 in accordance with the curved shape of the intermediate transfer roller 57. Therefore, a sufficient heating time is secured so that the intermediate transfer roller 57 can be effectively heated although the heat source which has a relatively small heating ability is used. A noncontact heating source 15 for heating the heating belt 11 can be disposed instead of disposing the heating roller 14 as shown in FIG. 7.

Third Embodiment

In the modification example device as shown in the FIG. 3, the secondary transfer bias roller 56 is operated as a pressing roller for pressuring the transfer paper P in which the toner image from the intermediate transfer roller 57 is transferred toward the intermediate transfer roller 57. In the printer according to the third embodiment, the heat source is disposed in the secondary transfer bias roller 56 as the pressuring roller, and the secondary transfer bias roller is also used as the heating device for the intermediate transfer roller 57. In the arrangement, the pressuring roller is also used as the heating device so that a space or the number of parts is reduced.

The printer for forming a single color toner image by using one photoconductivity and one developing unit 3 is described above. However, the present invention can be applied to a liquid type image forming apparatus for forming a color image by a following method. In other word, the method is that several developing devices are arranged around one latent image carrier, and single color toner images which are developed by different color toners on latent image carrier are sequentially superimposed to onto the intermediate transfer body, then the color image is formed by transferring the superimposed image. Another method for forming the color image is also used. The method is that several toner image forming units having at least the latent image carrier and the developing device are disposed around the intermediate transfer body, and a single toner image which is formed by each of toner image forming unit is superimposed onto the intermediate transfer body, and the color image is formed by transferring the superimposed image. The example of utilizing the photoconductor drum as the latent image carrier is explained; however, a photoconductor belt can be used as the latent image carrier.

In the printer according to the embodiment, and the printer according to the each embodiment and the modification example device, the heating device (the heating roller 8, the noncontact heating unit 9, and the heating belt unit 10) heats the intermediate transfer body (the intermediate transfer belt 51 and the intermediate transfer roller 57) in the following position. In other word, after the toner image of the visualized image is transferred onto the transfer paper P, it is the position for heating the intermediate transfer body where is before another toner image is entered to the primary transfer nip in which another toner image is intermediately transferred from the photoconductor 1 of the latent image carrier. Consequently, it is possible to avoid the situation that the toner image on the intermediate transfer body is disturbed by contacting to the heating device. It is also possible to avoid the transfer failure of the toner image caused by softening the toner on the intermediate transfer with heating and by decreasing the electric charge of the toner.

As the intermediate transfer body, the body includes the elastic layer which has the urethane resin as the material (51*b* and 57*b*) and the surface layer which contains the fluorine compound (51*a* and 57*b*). In this intermediate transfer body, the composition of the each layer can be adjusted respectively, so that the elastic layer can also bring out a sufficient elasticity and the surface layer can bring out sufficient toner releaseability. Moreover, by using the urethane resin as the elastic material of the elastic layer, the swelling of the elastic layer can be controlled with obtaining good elasticity.

The surface layer of the intermediate transfer body is provided with the conductivity. Therefore, the transfer electric field (secondary transfer electric field) is absolutely formed between the intermediate transfer body and the recording body with adopting the transfer method for achieving the electrostatic transfer from the intermediate transfer body to the recording body by applying the transfer bias. It is also possible to adopt the method for applying the transfer bias from the surface side of the intermediate transfer body instead of applying the bias from the inside.

The elastic layer of the intermediate transfer body is provided with the conductivity; therefore, the method for applying the transfer bias from the inside of the intermediate transfer body can be adopted.

In the printer according to the embodiment and the modification example devices, the heating roller 8 is used as the heating device. The heating roller 8 heats from the heat source which is disposed inside, and rotates with contacting to the intermediate transfer device. The deterioration of the toner releaseability of the intermediate transfer body caused by the friction with the heating device which does not migrate on the surface is avoidable. Unlike the case utilizing the heating device of the noncontact type, the heating device 8 can not be influenced by air current in the body of the printer, so that the heating device 8 can absolutely heat the intermediate transfer body.

The printer according to the first embodiment is provided with the noncontact heating unit as the heating device. In the arrangement, the deterioration of the toner releaseability of the intermediate transfer body which is caused by the pressure of the heating device is avoidable. The device for cleaning the hating device is not required to be disposed.

The printer according to the second embodiment is provided with the heating belt 11 which is moved endlessly with receiving the heat transfer from the heat source as the heating device, and the belt is contacted to the intermediate transfer body. In this arrangement, the deterioration of the toner releaseability of the intermediate transfer body caused by the friction with the heating device which does not be migrated the surface is avoidable. Moreover, a sufficient heating time is ensured by forming the long heating nip. Therefore, the intermediate transfer body can be heated effectively even though the heat source which has the relatively small heating ability is used.

In the printer according to the third embodiment, the secondary transfer bias roller 56 of the pressuring roller is operated as the heating roller of the heating device. In this arrangement, the space and the number of parts can be reduced by using the secondary transfer bias roller 56 as the heating device.

Following is about one embodiment when the image forming apparatus according to the second aspect of the present invention is applied to an electrophotography copying machine (hereinafter called a copying machine).

Figure 8:
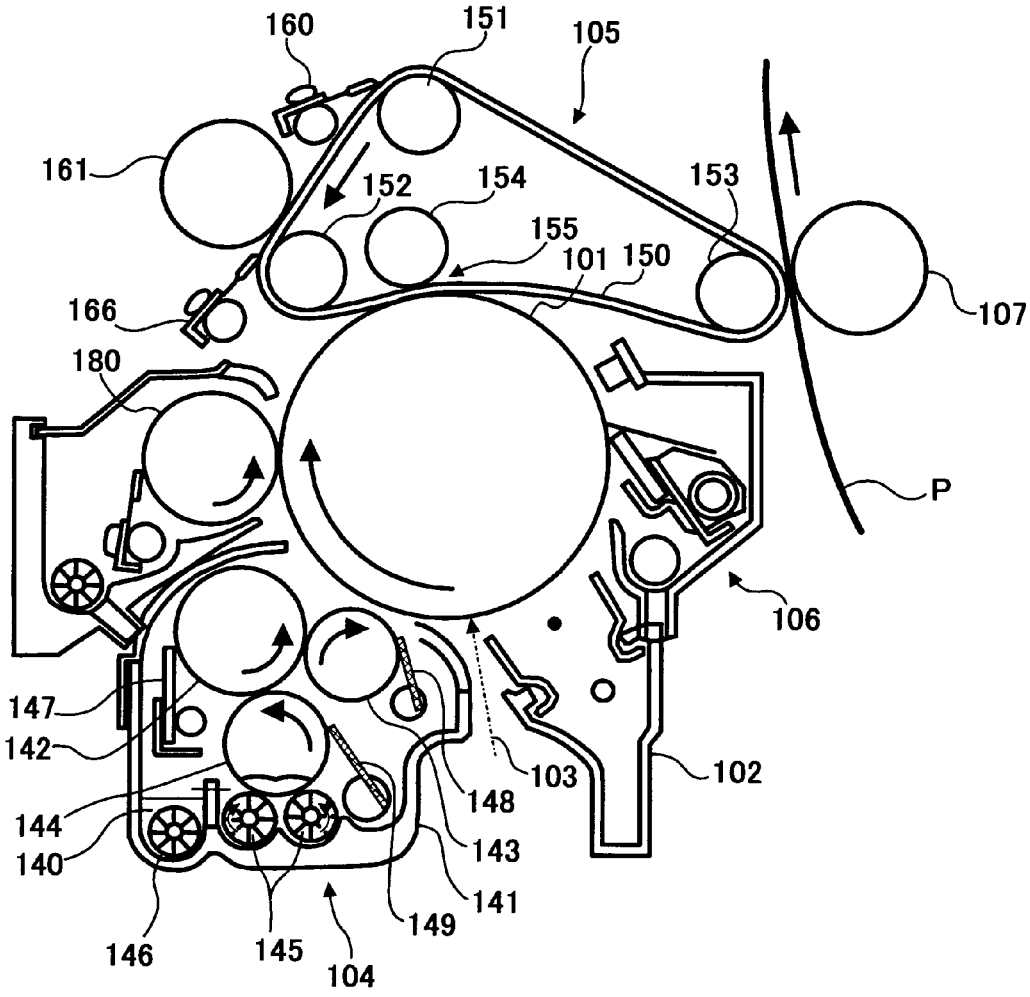
FIG. 8 is a schematic structural view of an image forming apparatus which uses the intermediate transfer belt shown in the second feature of the present invention.

FIG. 8 is the schematic structural view for the relevant part of the copying machine according to the present invention. In the copying machine according to the present invention, an electrification device 102, an exposure device 103, a liquid developing device 104, a primary transfer device 102 having the intermediate transfer body, a cleaning device 160, and so on are disposed around a photoconductor drum 101 as a latent image carrier. As a material of the photoconductor drum 101, aSi, OPC or the like can be utilized. A LED, a laser scanning optical system or the like is also used as the exposure device 103.

Following is an explanation about a case when an image is formed by reversely developing in the above mentioned arrangement of the copying machine. The photoconductor drum 101 is rotated in the direction of the arrow at a constant speed when the image is copied by a driving device such as a motor or the like (not shown). After the photoconductor drum 101 is uniformly charged to about 600V in a dark by the electrification device 102, an original optical image is illuminated and imaged by the exposure device 103, and then an electrostatic latent image is carried onto the surface of the photoconductor drum 101. After that the electrostatic latent image is developed during passing thorough the portion of the liquid developing device 104. The toner image which is developed onto the electrostatic latent image of the photoconductor drum 101 is transferred onto an intermediate transfer belt 150 as an intermediate transfer body by the primary transfer device 105, and then the toner image is transferred onto a transfer paper P from the intermediate transfer belt 150 by a secondary transfer device 107. After the photoconductor drum 101 is primary transferred, the residual toner is removed by the cleaning device 160. After that the residual electric potential on the surface of the photoconductor dram 101 is eliminated by a discharge lamp, and the dram is prepared for the next copying. The transfer paper P in which the toner image is transferred is discharged to the outside of the machine through a fixing device (not shown).

Liquid developer 140 used in this copying machine of the present invention will be explained. The liquid developer 140 has major components of coloring agent and binding agent, which is made of resin. The liquid developer is that the toner which is added agent for controlling electric potential is dispersed into carrier liquid having a major component of solvent including a high insulation performance and a low dielectric constant. In the copying machine of the present invention, the liquid developer 140 of a high viscosity and a high concentration is used instead of using a liquid developer of a low viscosity (about 1 mPa·s) and a low concentration (about 1%) in which generally Isopar (Exon Registered Trade Mark) is used as the carrier. As a range of the viscosity and the concentration for this developer 140, for example developer that the viscosity is from 50 mPa·s to 5000 mPa·s, and the concentration is from 5% to 40% is used.

As the carrier liquid, the carrier having the high insulation performance such as silicone oil, normalparaffin, Isopar M (Exon Registered Trade Mark), vegetable oil, mineral oil or the like is used. Volatile and nonvolatile of the liquid can be selected in accordance with the purpose.

The coloring agent has a role for actualizing the electrostatic latent image. Much inorganic and organic pigment and dye are included as the coloring agent, and carbon black, ultramarine blue, and iron blue, phthalocyanine type pigment, azine type pigment, triphenylmethane type pigment, azo type pigment and dye, condensation type pigment and dye, and so on are used as the coloring agent.

The binding agent is resin or polymer which has a role for fixing the image. In particular, the following materials are included as the binding agent; vinylester polymerization polymer which is typified by vinyl acetate, vinyl propionate and so on, and polymerization polymer of acrylic acid and methacrylicacidester. The following materials are further included as the binding agent; synthetic resin rubber which is typified by styrene-butadiene type, natural rubber, denaturated natural rubber, rosin, rosin denaturated resin, epoxy resin, silicone rubber, styrene resin, coumaroneindene resin, oil type resin which is typified by cyclopentadien polymerization polymer, ethylene-vinylacetate copolymer, ethylene-acrylicacid copolymer, ethylene-methylacrylate-acrylicacid copolymer, polyethylene wax and so on.

The agent for controlling an electric potential has a role for keeping stability a polarity of the toner. The following materials are used as the agent for controlling the electric potential; inorganic pigment, organic pigment, organic dye, resin and aromatic carboxylic acid which have polar group in molecule, alcohol, ketone, ester, ether, and amine and so on. The polymer which includes the above mentioned the agent for controlling the electric potential is also used. Moreover, various metallic soups such as cobalt naphthenate, octenoic acid manganese, and so on are used as required.

However the roles of the above mentioned component is not clearly divided, and for example the dye and the pigment sometimes have the roles for coloring and for controlling the electric potential at the same time. The resin and polymer having the polar group sometimes have the roles for fixing and for controlling the electric potential at the same time.

The particle diameter of the toner which is composed of these components is selected from submicron to about 6 $\mu$m according to the purpose.

In accordance with the using environment, dispersing agent which is made of liquid type resin is added in the liquid developer 140 for dispersing the toner in the carrier liquid efficiently. As the dispersing agent, polyethylene resin such as Sanwax E200, E250P, 131-P, and so on (Sanyo Chemical Industries, Ltd.), polypropylene resin such as Viscol 500P, 600P, and so on (Sanyo Chemical Industries, Ltd.), polypropylene resin such as DENKA Vinyl SS-100, SS-130, DSS-130, and so on (Denka Chemical Industry), paraffine wax, natural wax, surface-active agent, and so on are used.

The liquid developer device 104 which is adopted for the copying machine of the embodiment will be explained below. The liquid developer device 104 is mainly composed of a developer containing tank 141 which contains the liquid developer inside, a developing roller 142, a sweep roller 143, and an anilox roller 144 as a coating device, a gear pump 145, and an agitation roller 146. The developing roller 142 and the sweep roller 143 are respectively provided with cleaning members 147 and 148 which are made of a metal blade or a rubber blade. The blade is not necessary to be used as each of the cleaning members 147 and 148. A roller type is also used as each of the cleaning members 147 and 148. The anilox roller 144 is provided with a doctor blade 149.

Each of the developing roller 142 and the sweep roller 143 is provided with a layer for an elastic body having conductivity on each surface. Urethane rubber can be used as a material for the layers of these elastic bodies. It is desirable for a rubber hardness of the layer of each elastic layer to be below 50 degree with JIS-A hardness. The material for the layer of each elastic body is not required to be the urethane rubber. It is possible to use the material, which has the conductivity and, is not swelled and dissolved by the carrier liquid and the developer. Each surface of the developing roller 142 and the sweep roller 143 has conductivity, and the surfaces are made of the material which is not swelled and dissolved by the carrier liquid and the developer. If the arrangement of the layer is that the inside of the layer is not contacted by the carrier liquid and the developer, the conductivity and the swelling and the dissolution are not required for the material of the layer of each elastic body as the inside layer, and only the elasticity is required for the material for the inside layer. At this point, developing bias electric pressure and sweep bias electric pressure are necessary to be applied from the surfaces of the rollers not from the shafts of the developing roller and the sweep roller. The construction that the layer of the elastic body is provided on the photoconductor side can be used instead of using the arrangement that the layer of the elastic bodies are provided on the developing roller 142 and sweep roller 143. The photoconductor is also constructed by a material of an endless belt type. The developing roller 142 and the sweep roller 143 are constructed to include the smoothness of the surface below Rz 3 $\mu$m by coating or tubing.

FIG. 8 shows the developing roller 142 which is positioned apart form the photoconductor drum 101 when the development is not operated. When the development is operated, the developing roller 142 is come into contact with the photoconductor drum 101 by an appropriate pressure. When the developing roller 142 and the sweep roller 143 are come into contact with the photoconductor drum 101 by the appropriate pressure, the layer of the elastic body for each roller is elastically deformed, and a developing nip and an elimination nip are formed. Especially, a constant developing time that the toner of the developer 140 is moved toward the photoconductor drum 101 for adhering the toner by a developing electric field of a developing range can be ensured by forming the developing nip. The nip width which is also the amount of the surface migration direction in each nip section can be adjusted by adjusting the contacting pressure. The each of the nip width is set to more than the product of the constant number at developing and the liner velocity of each roller. At this point, the constant number at developing is the time which is required for the development amount to be saturated, and it is the number that the nip width is divided by the process speed. For example, if the nip width is 3 mm and the process speed is 300 mm/sec, the constant number at developing is 10 msec.

When the development is operated, a thin layer of the liquid developer 140 is formed onto the developing roller 142 by the anilox roller 144. At this point, in the thickness for the thin layer of the liquid developer 140, which is coated on the developing roller 142, the content amount of the pigment in the toner which is carried per 1 $cm^2$ of its surface is set to be more than 3 mg and below 60 mg. Therefore the thin layer of the liquid developer 140 is applied to be 3 to 10 $\mu$m in the thickness. If the applied layer of the liquid developer 140 is the thickness that the content amount of the pigment in the toner which is carried per 1 $cm^2$ of the surface of the developing roller 142 is to be smaller than 3 $\mu$g, the sufficient amount of the pigment is not moved on to the image portion of the latent image which is formed onto the photoconductor drum 1, and the image concentration of the image portion may be thinned. If the thickness is that the content amount of the pigment in the toner which is carried per 1 $cm^2$ of the surface of the developing roller 142 is to be more than 60 $\mu$g, the amount of the toner surplus which remains in the naked portion after developing is increased, and then the toner surplus can not be eliminated completely by the sweep roller 143.

The thin layer of the liquid developer 140 which is formed onto the surface of the developing roller 142 passes through the developing nip which is formed by the photoconductor drum 101 and the developing roller 142.

Generally, in the developing device of the photoelectrography, the sufficient toner is sent to the area in which the photoconductor faces the developing unit, so that the surface migration speed of the developing roller is set to be faster than the surface migration speed of the photoconductor. Therefore the toner has a faster surface migration speed than the surface of the photoconductor, so that the positional gap is caused between the toner and the latent image, and phenomena such as a thin spot for the leading end of the image and an unbalanced between the vertical line and the horizontal line are caused. These phenomena are caused for the liquid developing. In the copying machine according to the present invention, the surface of the developing roller 142 and the surface of the photoconductor 101 are moved at almost same speed, and a rate vector in a tangential direction of the photoconductor drum 101 with respect to the toner is not included, so that the above mentioned phenomena are not caused.

The developing bias voltage (400V) which is lower than the photoconductor surface potential (600V) is applied onto the developing roller 142. The developing electric field is generated between the developing roller 142 and the image portion which is exposed to be below 50V by the exposure device 103. In the image portion of the photoconductor drum 101, the toner in the developer 140 is migrated to the photoconductor drum 101, and visualizes the latent image. On the other hand, in the naked portion (non-image portion), the electric field is formed by the developing bias electric potential and the photoconductor electric potential, so that the toner is migrated to the surface of the developing roller 142 and is not adhered to the naked portion.

However, when some of the toner in the naked portion can not migrate to the surface of the developing roller 142 and remains at the photoconductor drum 101 side, it causes the fogging. Consequently, the developing device 104 of the printing machine according to the present invention is provided with the sweep roller 180 in order to sweep the toner causing this fogging (hereinafter referred to the fogging toner). The sweep roller 180 is disposed in the downstream side of the rotation direction of the photoconductor drum 101 with respect to the developing roller 142. The sweep roller 180 is disposed to sandwich the developed toner layer with pressing the photoconductor drum 101. The surface of the sweep roller 180 and the surface of the photoconductor 101 are moved at about the same speed.

In the sweep roller 180, the bias of the voltage (250V) which is close to the toner layer surface potential of the image portion on the photoconductor drum 101 (50 to 200V) is applied in such a manner that the toner from the toner layer of the image portion after developing is not returned to the sweep roller 180. In the naked portion, the swimming fogging toner is migrated to the sweep roller 180 by the electric field generated by the electric potential difference between the naked portion of the photoconductor drum 101 and the bias of the voltage. At this point, the thickness of the developer layer of the naked portion is substantially half of the developing nip portion of the developing roller 142, and the concentration of the toner is decreased to about below 50% of the concentration before the developing, so that the fogging toner is easily eliminated. Thereby the fogging of the naked portion is completely prevented.

The primary transfer device 105 and the secondary transfer device which are utilized the intermediate transfer body adopted for the copying machine of the present invention will be explained below.

The copying machine in FIG. 8 utilizes the intermediate transfer belt 150 of the endless belt in which the several rollers 151, 152, and 153 as the intermediate transfer body are wound. One of the several rollers selected from 151, 152 and 153 is used as a driving roller, and rotates the intermediate transfer belt 150 in the counterclockwise direction as shown in the view. The intermediate transfer belt 150 is disposed to contact onto the surface of the photoconductor drum 101 at the primary transfer position 155. The voltage which is the opposite electrode to the electrification electrode of the toner on the photoconductor drum 101 is applied from the primary transfer roller 154 at the primary transfer position 155, so that the toner on the photoconductor drum 101 is transferred onto the intermediate transfer belt 150.

The secondary transfer roller 107 as the secondary transfer device is disposed in the right side of the intermediate transfer belt 150 with sandwiching the intermediate transfer belt 150. The secondary transfer roller 107 is disposed through the intermediate transfer belt 150 with pressing the roller 153, and the secondary transfer belt roller 107 transfers the toner image on the intermediate transfer belt 150 onto the transfer paper. In the vicinity of the roller 151, an intermediate transfer body cleaning blade 160 as an intermediate transfer body cleaning device to remove the carrier liquid and the residual toner on the intermediate transfer belt 150 after the secondary transfer to the transfer paper is carried out.

The 2.5 mm of the endless belt material in which carbon black is mixed in polyurethane to obtain the volume resistivity of $10^7$ to $10^{12}$ Ω·cm is used as the endless belt. If the volume resistivity is in this range, the electric potential record generated by the secondary transfer voltage and the photoconductor surface potential is hard to be remained on the intermediate transfer belt 150, and the transfer bias which is applied from the voltage applying member of the inside can be utilized effectively.

Figure 9:
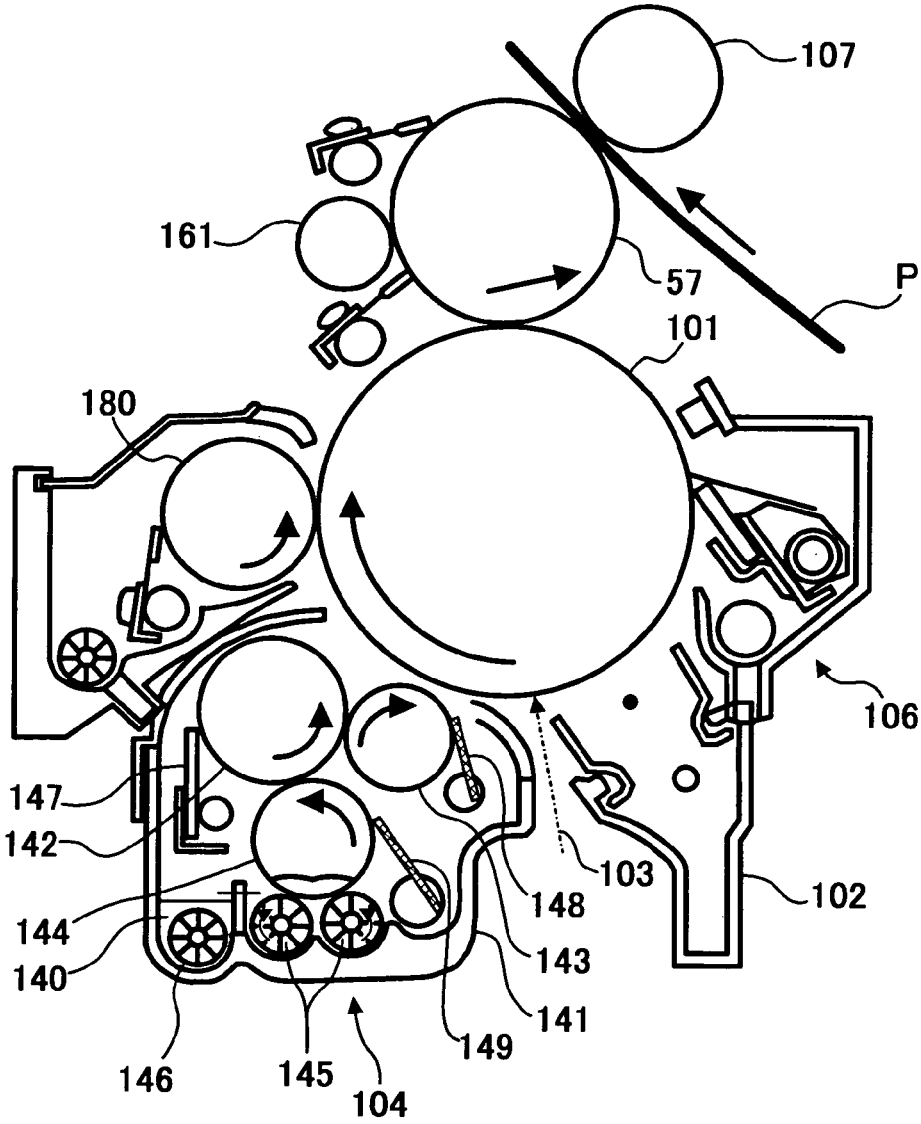
FIG. 9 is a schematic structural view of an image forming apparatus which uses the intermediate transfer roller of the embodiment.

As shown in FIG. 9, an intermediate transfer roller 57 may be utilized as the intermediate transfer body. As the arrangement of the intermediate transfer roller 57, a drum type in which a metal drum is wound by the endless intermediate transfer belt as shown in the FIG. 8 can be used. Moreover, as described in the first feature, the arrangement in which the elastic body layer 57*b* having the conductivity and the heat resistance and the surface layer 57*a* having the conductivity, the heat resistance, the separation ability, and preferably the resistance of silicone oil are coated on the rigid drum 57*c* which is made of the metal such as aluminum or the like as shown in FIG. 4. At this point, the drum 57*c* includes the conductivity so as to apply the voltage from the shaft in order to transfer the toner image of the photoconductor drum 101 onto the intermediate transfer roller 57 by the electrostatic action. The drum 57*c* also includes the hardness which is for adding a required pressure in order to transfer the toner onto the recording body such as the paper or the like. It is preferable for the surface roughness of the surface layer is below about average particle diameter of the toner (1 μm).

The surface of the this intermediate transfer body is coated with resin containing fluorine such as polyfluorovinyl, polyfluorovinylidene, polytrifluoroethylene, polytetrafluoroethylene or the like and conductive polyurethane resin in which fluorosilicone rubber and fluorine are compounded. A coating method includes a spray coating, a dip coating, a ring coating and so on.

In this copying machine, the ratio of the carrier liquid in the liquid developer is low and the rate of the solid content of the toner is high on the intermediate transfer body, and the resin or the like which is contained in the toner is easy to be adhered to the intermediate toner body. The resin which is adhered to the intermediate transfer body is firmly fixed onto the intermediate transfer body by receiving pressure and heat, and it has a possibility to deteriorate the transfer performance. Consequently, the copying machine of this embodiment is provided with a device for eliminating a substance on the intermediate transfer body in order to remove the substance such as the resin or the like which is adhered to the surface of the intermediate transfer body.

The device for eliminating the substance on the intermediate transfer body will be explained below.

A substance eliminating member which is contacted to the surface of the intermediate transfer body is disposed as the device for eliminating the substance on the intermediate transfer body, and the substance on the intermediate transfer body is removed by rubbing on the surface of the intermediate transfer body with the device.

FIG. 8 and FIG. 9 are the examples in which a substance eliminating roller 161 as the substance eliminating member is provided as the substance eliminating member. The substance eliminating roller 161 is a form roller type in which blowing agent having breathability is provided around the core. This example will be explained below based on the FIG. 9. In the periphery of this substance eliminating roller 161, a substance eliminating roller case (not shown) which covers the around the substance eliminating roller 161 and has an opening at the facing portion to the intermediate transfer roller 57 of the intermediate transfer body and a driving device of the substance eliminating roller are disposed. The substance eliminating roller 161 rubs the intermediate transfer roller 57 with rotating to the opposite direction with respect to the migration direction of the intermediate transfer roller 57 by the driving device. The substance which is adhered and is firmly fixed onto the intermediate transfer roller 57 is thereby removed. The driving device of the substance eliminating roller 161 is constituted by a timing pulley, a timing belt, a motor and so on. The substance eliminating roller 161 can eliminate the substance by contacting to the intermediate transfer roller 57 while the image forming is carried out. However, the substance eliminating roller 161 can be constructed in such a manner for example, while the image forming is not carried out, the roller 161 is disposed apart from the intermediate transfer roller 57 by a separation device (not shown), and while the image forming is not carried out, the roller 161 is contacted to the intermediate transfer roller 57. The substance eliminating roller 161 are rotated to the opposite direction with respect to the moving direction of the intermediate transfer roller 57 with the condition in which the substance eliminating roller 161 is contacted to the intermediate transfer roller 57. The substance which is adhered and is firmly fixed onto the intermediate transfer roller 57 is thereby removed. The blowing agent which constructs this substance eliminating roller 161 can be deformed easily; therefore, the substance which is adhered along the irregularity on the surface of the intermediate transfer roller 57 can be removed.

As the blowing member for constructing the substance eliminating roller 161, for example, polyurethane form in which melamine resin of heat-hardening resin is foamed and melamine form can be used. The urethane form roller has an excellent oil-resisting, an excellent heat resistance, an excellent solvent resistance, and an excellent abrasion resistance. When the melamine form roller is used, an extremely high substance eliminating ability can be obtained. This is because that the polyurethane form and so on are constructed by a membrane; however, the melamine form is formed by a framework (i.e. an open cell), and the ability of removing the substance by the framework is higher than the ability of removing the substance by the membrane. The melamine form is formed only by the framework, so that it is lightweight and has further excellent breathability. The substance eliminating member which utilizes the melamine form includes an excellent substance eliminating ability. The melamine resin is also called as melamine-formaldehyde resin, and it is a heat-hardening resin which is obtained from the melamine and the formaldehyde. The melamine form has an excellent heat resistance (safety temperature for using: −60° C. to 150° C.), an excellent chemical resistance, an excellent solvent resistance, and so on.

The substance eliminating member does not scratch the surface of the intermediate transfer body and can not loose the releaseability of the surface of the intermediate transfer body, so that it is preferable for the hardness of the substance eliminating member to be softer than the surface of the intermediate transfer body. The substance which is firmly fixed onto the intermediate transfer body in accordance with the using environment, liquid or solid resin which is contained in the developer is mainly used. If the hardness of the substance eliminating member is harder than the resin which is contained in the developer, the substance can be removed effectively. When the substance which is firmly fixed onto the intermediate transfer body is removed by the substance eliminating member, the waste of the substance is accumulated. Therefore, a blade 166 or the like as the cleaning member is disposed in the downstream side of the substance eliminating roller 161 so as to collect the waste by this blade 166.

In order to eliminate the substance effectively by the substance eliminating member, it is preferable for the surface roughness of the substance eliminating member to be rougher than the surface roughness of the intermediate transfer body. Even when the substance is adhered or is firmly fixed onto the concave portion of the surface of the intermediate transfer body, if the surface roughness of the substance eliminating member is rougher, the substance eliminating member can be reached to the substance which is remained in the concave portion of the surface of the intermediate transfer body, and the member can sweep the substance. On the other hand, if the surface roughness of the intermediate transfer body is rougher than the surface roughness of the substance eliminating member, sometimes the substance eliminating member can not be reached to the concave portion of the surface of the intermediate transfer body, so that the substance can not be eliminated effectively.

The substance eliminating member can be operated while an image is formed as mentioned above. If the substance eliminating member is operated while the image is formed, the operation time for eliminating the substance is long, and the substance is always eliminated while an image is formed, so that the firmly fixing of the substance can be prevented absolutely.

It is also possible to construct the substance eliminating member detachably to the intermediate transfer body. While the image is formed, the substance eliminating member is disposed apart from the intermediate transfer body, and is operated by contacting to the intermediate transfer body when it is required. The substance eliminating operation can be conducted after certain period of times while the image is formed, for example in every certain printing number, in every certain time, or the like. It is possible to recognize the condition such as the adhesion and the firm fixation in advance so as to operate the substance eliminating member. For example, when an electric source of the image forming device is turned on, the intermediate transfer body is rotated, and the operation in which the detachable substance eliminating member is rotated with contacting to the intermediate transfer body can be conducted, for example during one minutes or the like and during the certain period of time. When several thousand of papers are printed at once, the image forming is paused, for example in every thousand paper, and the above mentioned substance eliminating operation can be operated for a certain period of time. When a continuous printing during several hours at once is carried out, the image forming is paused, for example the image forming is paused in every hour, and the substance eliminating operation can be carried out for the certain period of time. Moreover, it is possible to dispose a sensor for detecting the condition of the adhesion and the fixation of the substance, for example such as a device for detecting a friction on the surface and a reflectance of a light so as to detect the condition of the adhesion and the fixation, and conduct the substance eliminating operation.

When the substance is eliminated by utilizing the substance eliminating member, if the intermediate transfer body is cooled down or is warmed, the efficiency of eliminating the substance may be increased. When the substance is made of the resin, the resin tends to be softened or be hardened by the temperature. Generally, the resin is hardened by cooling. If the intermediate transfer body or the surface of the intermediate transfer body is cooled down, the substance which is made of the resin on the intermediate transfer body is hardened such as a powder type or a flake type, and the substance may be eliminated easily from the intermediate transfer body. The eliminating efficiency of the substance which has this characteristic can be improved by cooling the intermediate transfer body and the surface of the intermediate transfer body.

As a device for cooling the intermediate transfer body, an air cooling which uses an air current, a liquid cooling in which cooled liquid is circulated in a pipe or the like, a heat pipe and so on are used. The case using the heat pipe which has good heat conductivity will be explained. In the heat pipe, a capillary material of a candle wick shape is lined inside, and it is a metal seal pipe in which a small amount of operation agent is contained in vacuum. In the heat pipe, the heat is absorbed from one side by the evaporation of the operation agent, and the heat is released at another side by the aggregation of the vapor. As the operation liquid of the heat pipe, for example, ethylalcohol is used. The heat pope as the cooling device is disposed in the outer portion of the intermediate transfer body so as to rotate with the intermediate transfer body. The surface of the intermediate transfer body is cooled down by the contact heat transmission between the heat pipe roller and the intermediate transfer body. The cooling device can be arranged inside of the intermediate transfer body.

Generally, the resin is softened by warming. If the resin is firmly fixed onto the intermediate transfer body, and even thought it is hard to be eliminated by using the substantial eliminating member having the roughness and the hardness, the resin in the intermediate transfer body or only the surface of the body is softened by warming, and the resin may be swept away by the substance elimination member. Therefore, in the resin which has this characteristic, the elimination efficiency of the substance is improved by heating the intermediate transfer body or the surface of the body.

As a heating device for the intermediate transfer body, following methods are included; a method for rotating a heat roller having a heat source inside with contacting to the surface of the intermediate transfer body, a method for heating the intermediate transfer body by radiation heating from a noncontact heating heat source, and a method for rotating the heat belt which is contacted to the heat source with contacting to the intermediate transfer body having a sufficient nip portion. As described in the first feature (FIG. 5), when the noncontact heating heat source by the radiation heating is utilized, the surface of the intermediate transfer roller 57 can be heated without contacting by the halogen lamp 9*b* having the reflection plate 9 (FIG. 5).

Figure 10:
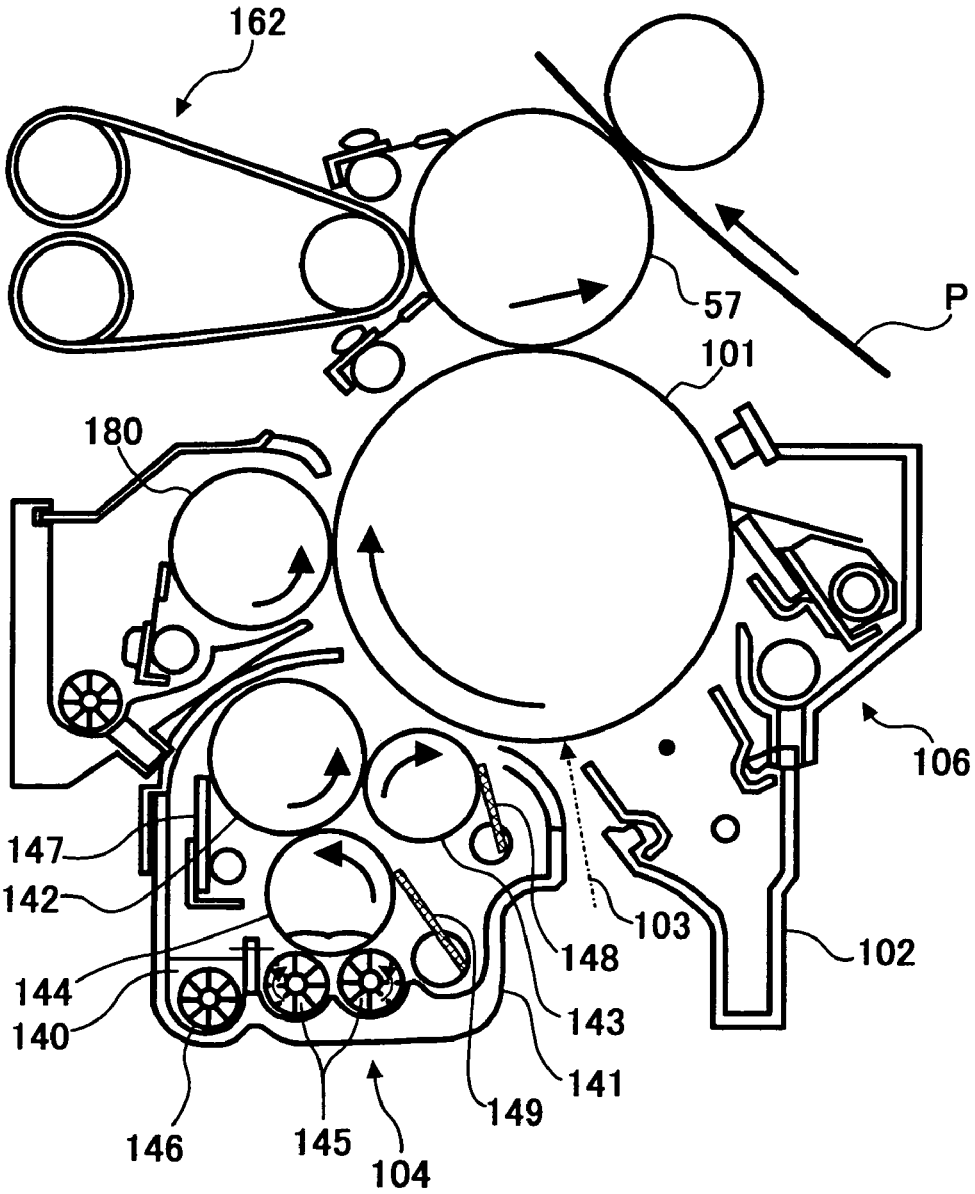
FIG. 10 is a schematic structural view of an image forming apparatus which uses a nonwoven fabric as a device for eliminating a substance on the intermediate transfer body.

An example using a nonwoven fabric 162 as the substance eliminating member is explained in FIG. 10. The nonwoven fabric 162 is driven to move in the opposite direction to the surface migration direction of the intermediate transfer roller 57. In the contacting portion between the nonwoven fabric 162 and the intermediate transfer roller 57, the nonwoven fabric 162 scrubs the intermediate transfer roller 57, and catches effectively the substance such as the powder paper and the resin which are adhered and firmly fixed. In the present embodiment, the nonwoven fabric 162 is a combined fabric which is formed by crossing the fabrics. If is preferable for catching the fine powdered paper in the fabric to use the fabric having a high flexibility. As a material for the nonwoven fabric 162, a fabric having a characteristic that the surface of the intermediate transfer body is not damaged when the surface of the intermediate transfer roller 57 is scrubbed by the nonwoven fabric 162 is used. The nonwoven fabric can be deformed easily, so that the fabric can be easily followed to the surface of the intermediate transfer roller 57. The fine irregularity formed by crossing the fabrics is effective to sweep the substance which is adhered and is firmly fixed along the surface irregularity of the intermediate roller 57.

Figure 11:
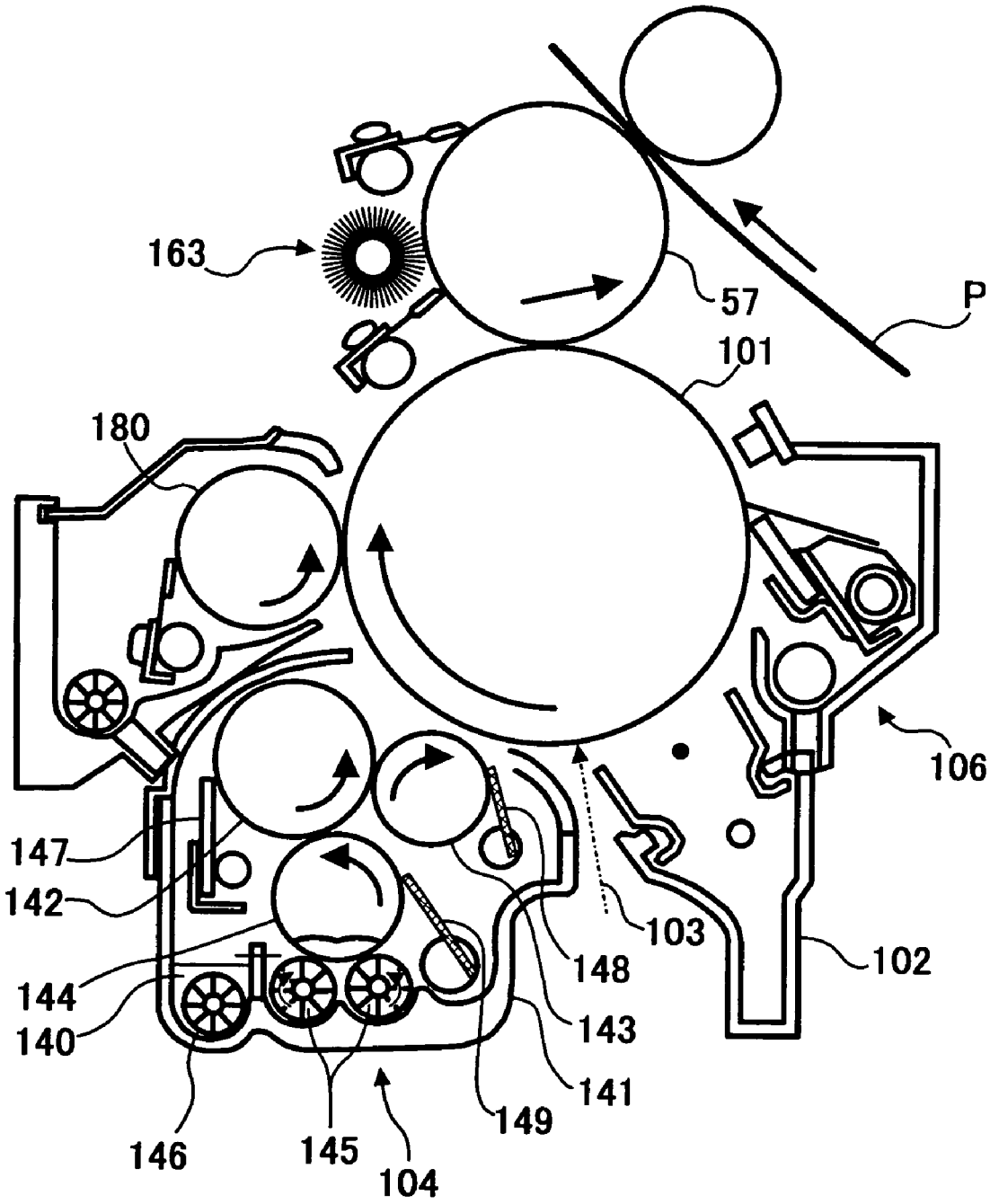
FIG. 11 is a schematic structural view of an image forming apparatus which uses a brush roller as the device for eliminating the substance on the intermediate transfer body.

FIG. 11 shows an example using a brush roller 163 as the substance eliminating member. The brush can sweep the substance effectively in the direction that the moving direction of the brush roller 163 is the opposite direction with respect to the surface migration direction of the intermediate transfer roller 57 (same as the rotation direction of the roller), or the same direction (the opposite direction of the rotation direction of the roller). However, when the moving direction of the brush is the opposite direction of the surface migration direction it is effective; it is effective because the differences of the liner velocity is large.

Figure 12:
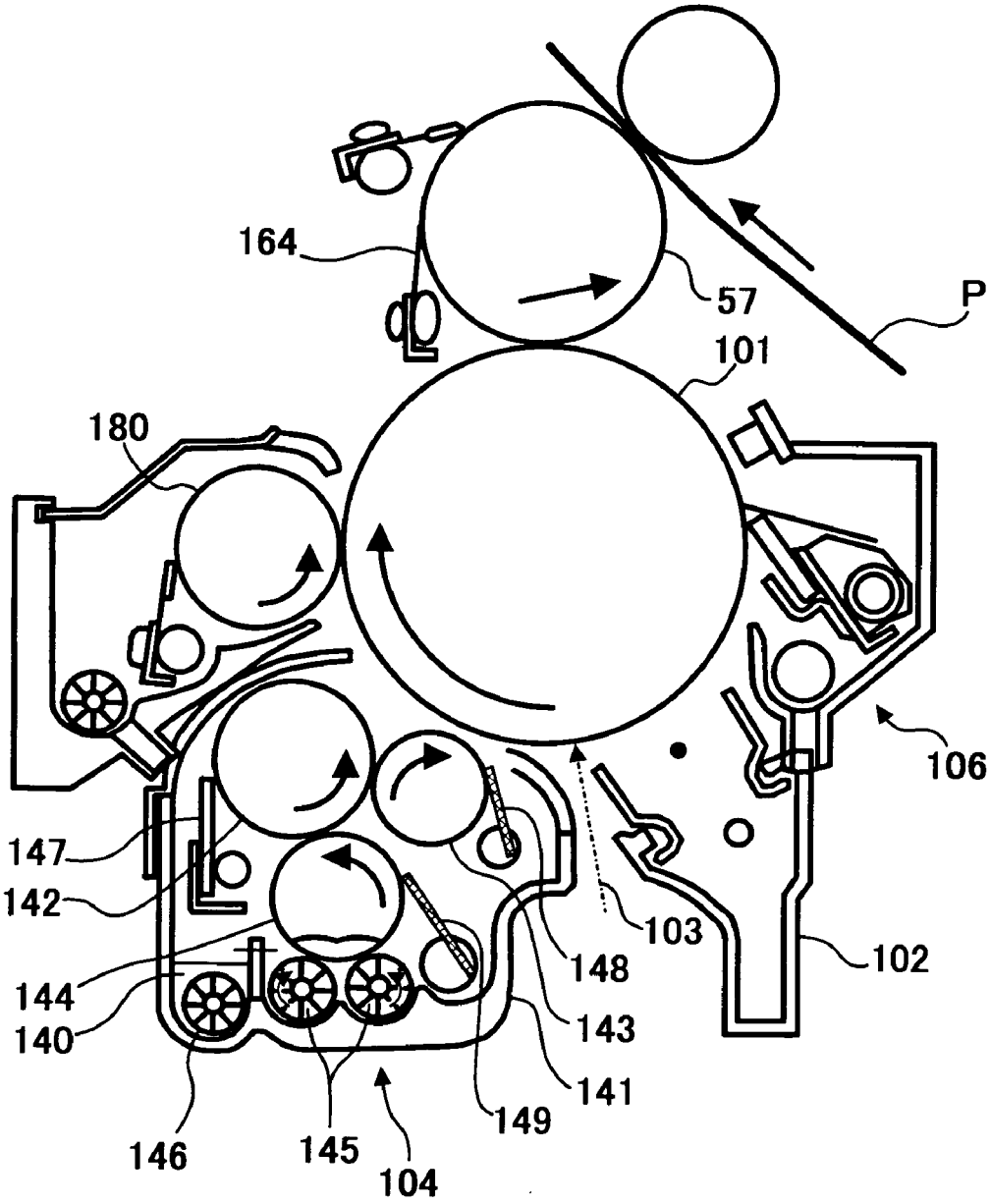
FIG. 12 is a schematic structural view of an image forming apparatus which uses a metal blade as the device for eliminating the substance on the intermediate transfer body.

FIG. 12 is an example using a metal blade 164 as the substance eliminating member. It is effective for the metal blade 164 to rotate in the opposite direction with respect to the rotation direction of the intermediate transfer roller 57. The thickness of the rubber blade is relatively thick, and the rubber blade is hard to sweep the substance such as the resin and so on which are firmly fixed. However, if the metal blade 164 is used, the thickness can be reduced so that it is an appropriate for sweeping the fixed substance, and the fixed substance which can not be swept by the varied rubber blades can be swept away by the metal blade 164.

Figure 13:
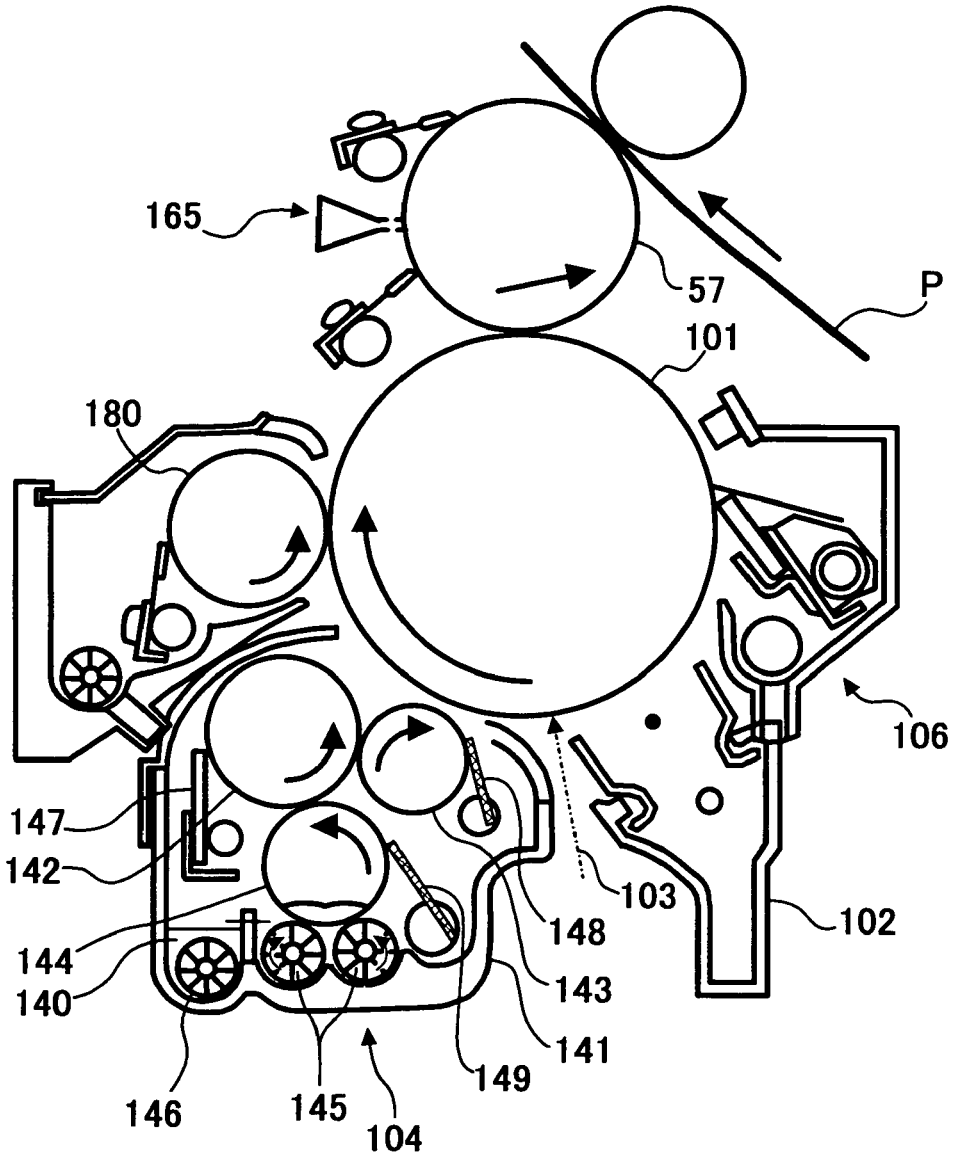
FIG. 13 is a schematic structural view of an image forming apparatus which uses high pressure steam as the device for eliminating the substance on the intermediate transfer body.

A device which sprays high temperature vapor (high temperature steam) into the intermediate transfer body is included as an example of other device example of the intermediate transfer body. FIG. 13 shows the example of the device for eliminating the substance of the intermediate transfer body using the high vapor. As shown in FIG. 13, the device is provided with a device 165 for spraying the high temperature steam toward the surface of the intermediate transfer roller 57 from a jet nozzle. The high temperature steam is sprayed onto the surface of the intermediate transfer roller 57, and the substance which is adhered and is firmly fixed onto the surface of the intermediate transfer roller 57 is floated by using the high temperature of the vapor and the pressure. The temperature of the high temperature steam is set to 80 to 100° C. When the steam is passed through the narrow jet nozzle, the seam is swiftly spewed.

It is more effective if solvent which can dissolve the adhered and the fixed substance is used before the substance eliminating device is used or at the same time of the substance eliminating device is used. As the solvent, it is advantageous to use solvent having a higher solubility in solvent which does not dissolve the material for the surface of the intermediate transfer body. It depends on the material for the surface of the intermediate transfer body; however, as the solvent having the higher solubility, for example, decan, pentane, hexane, heptane, and so on are used. These solvent is coated on the surface of the intermediate transfer body before or at the same time the device for eliminating the substance is used, and the substance is easy to be swept by dissolving the substance.

A device for collecting the substance, which is swept or is floated by the solvent or the device for eliminating the substance, may be required. Therefore, it is better to dispose a cleaning blade 166 in the downstream side of the substance eliminating device, and to collect the swept substance. The cleaning blade 166 can be used as the cleaning device for cleaning the residual toner of the secondary transfer during forming an image.

More than two substance eliminating devices are used as the substance eliminating device. The construction of the whole apparatus becomes complicated by using the two substance eliminating devices; however, the substance can be eliminated absolutely.

As described above, according to the image forming apparatus of the embodiment, in the image forming apparatus which uses the liquid developer, a high quality image can be obtained with maintaining an excellent transfer performance for a long time and preventing the adhesion of the substance to the intermediate transfer body.

There is the device which uses the form roller 161 as the device for eliminating the substance on the intermediate transfer body. The form roller 161 rubs the surface of the intermediate transfer body, and sweeps away the substance of the surface of the intermediate transfer body. The form roller 161 is easily deformed, so that the substance which is adhered along the irregularity on the surface of the intermediate transfer body can be swept away. The substance is thereby eliminated effectively.

There is the device which uses the nonwoven fabric 162 as the device for eliminating the substance on the intermediate transfer body.

The nonwoven fabric rubs the surface of the intermediate transfer body, and sweeps away the substance on the intermediate transfer body. The fabrics of the nonwoven fabric 162 are crossed, and this fine crossed fabric is preferable for catching the fine substance between the fabrics. The nonwoven fabric 162 is easy to be deformed, and the nonwoven fabric is easy to be followed to the surface of the intermediate transfer body. It is the advantageous for sweeping the substance adhered and firmly fixed along the surface irregularity of the intermediate transfer body. The substance is thereby eliminated effectively.

There is the device which uses the metal blade 164 as the device for eliminating the substance on the intermediate transfer body. The metal blade 164 rubs the surface of the intermediate transfer body and sweeps away the substance on the intermediate transfer body. The rubber blade is relatively thick, so that it is hard to sweep the substance such as the resin or the like which is firmly fixed. On the other hand, if the metal blade 164 is used, the thickness can be reduced, so that it is better to sweep the fixed substance away, and the fixed substance which can not be swept by the varied rubber blades can be swept. The substance is thereby eliminated effectively.

The substance eliminating member in which the hardness of the member is softer than the surface of the intermediate transfer body and is harder than the surface of the substance is used as the device for eliminating intermediate transfer body. This substance member rubs the surface of the intermediate transfer body, and sweeps the substance on the intermediate transfer body. The substance is thereby swept without damaging the surface of the intermediate transfer body.

The substance eliminating member in which the surface roughness is rougher than the surface roughness of the intermediate transfer body is used as the device for eliminating the substance on the intermediate transfer body. This substance eliminating member rubs the surface of the intermediate transfer body and sweeps the substance on the intermediate transfer body. Therefore, when the substance is adhered or is firmly fixed on the concave portion on the surface of the intermediate transfer body, if the surface roughness of the substance eliminating member is rougher, the substance eliminating member can be reached to the bottom portion of the concave portion on the surface of the intermediate body, so that the substance can be swept. On the other hand, if the surface roughness of the intermediate transfer body is rougher, the substance eliminating member sometimes can not be reached to the concave portion of the intermediate transfer body, so that the substance can not be eliminated effectively.

There is the device 165 which sprays the high vapor into the intermediate transfer body is used as the device for eliminating the substance on the intermediate transfer body. The substance is flowed by the pressure with softening the substance by the heat, and the substance is swept away. This device can eliminate the substance which is adhered along the surface roughness of the intermediate transfer body.

In addition to the members which rub the surface of the intermediate transfer body, the device for cooling the intermediate transfer body which cools the intermediate body or the surface of the body is disposed. Some of the resin which is adhered to the intermediate transfer belt is hardened by cooling, and becomes the flake type. Therefore, the resin is easy to be eliminated. The resin which has this characteristic can improve the eliminating efficiency of the substance by cooling the intermediate transfer body or the surface of the body.

In addition to the member which rubs the surface of the intermediate transfer body, the device for heating the intermediate transfer body or the surface of the body is disposed. Some of the resin which is adhered onto the intermediate transfer body includes the characteristic that the resin is softened by heating, and the resin is easy to be swept by the lowered viscosity. The elimination efficiency of the substance for the resin which includes this characteristic is improved by heating the intermediate transfer body or the surface of the body.

The solvent coating device for coating the solvent which does not dissolve the surface of the intermediate transfer body on the surface of the intermediate transfer body is arranged. Therefore, the substance is dissolved, and the substance is easy to be swept, so that the elimination efficiency of the substance is effectively improved.

The cleaning device 166 as the cleaning member is disposed in the downstream of the device for eliminating the substance on the intermediate transfer body. The substance which is swept by the device for eliminating the substance on the intermediate transfer body is absolutely collected by this cleaning blade 166.

There is the method for adding the dispersing agent which is made of the liquid type resin in order to sufficiently disperse the toner into the carrier liquid. This resin is the liquid type, and has the high viscosity, so that the resin is adhered and firmly fixed onto the intermediate transfer body easily. The substance on the intermediate transfer body is eliminated by the device for eliminating the substance on the intermediate transfer body. Therefore, if the liquid developer which contains the liquid resin is used in accordance with the using condition, it is possible to prevent the adhesion and the fixation of the substance onto the intermediate transfer body.

In one example, the substance elimination can be carried out during forming the image. This is because it has the long operation times for the substance elimination, so that the substance can be eliminated immediately while the image is formed, and the fixation of the substance is absolutely prevented.

In other example, the substance elimination can be carried out while an image is not formed. By using this example, even though a vibration is caused when the substance elimination is operated, it has no influence on the image forming. The substance elimination is carried out intermittently; therefore, the energy can be saved.

The substance elimination can be conducted every certain time or every certain number of printing. The substance which is adhered regularly to the surface of the intermediate transfer body is thereby eliminated.

More than two devices for eliminating the substance on the intermediate transfer body can be used. The substance elimination is thereby carried out certainly.

According to the image forming apparatus of the first feature of the present invention, the intermediate transfer body which contains the fluorine compound at least on the surface is heated by the heating device. Therefore the deterioration of the toner releaseability caused by the friction and the pressure of the surface of the intermediate transfer body is controlled. Even though, the toner releaseability is deteriorated by the friction and the pressure, the toner releaseability can be recovered to some degree. As the result, the image deterioration caused by the transfer fault from the intermediate transfer body to the recording body can be controlled for long processing hours.

According to the image forming apparatus of the second feature of the present invention, a high quality image can be obtained by preventing the adhesion of the substance onto the intermediate transfer body with maintaining an excellent transfer performance for a long time.

What is claimed is:

1. A liquid type image forming apparatus comprising:

a latent image carrier configured to carry a latent image;

a developing device configured to develop the latent image on the latent image carrier into a visualized image by a liquid developer containing a toner in a carrier liquid;

a primary transfer device configured to electrostatically and intermediately transfer the visualized image on the latent image carrier onto an intermediate transfer body; and a secondary transfer device configured to electrostatically transfer the visualized image on the intermediate transfer body onto a recording body, wherein a fluorine compound is contained in at least a surface of said intermediate transfer body, a heating device configured to heat the intermediate transfer body is provided, and the heating device is disposed at a downstream side of the secondary transfer device and an upstream side of the primary transfer device and is thereby configured to heat the intermediate transfer body at a position after the visualized image has been transferred onto the recording body and before another visualized image is intermediately transferred from the latent image carrier.

2. The liquid type image forming apparatus according to claim 1, wherein said intermediate transfer body includes an elastic layer which has a material of urethane resin and a surface layer which contains the fluorine compound.

3. The liquid type image forming apparatus according to claim 2, wherein said surface layer includes conductivity.

4. The liquid type image forming apparatus according to claim 2, wherein said elastic layer includes conductivity.

5. The liquid type image forming apparatus according to claim 1, wherein said heating device has a heating roller which is heated from a heat source disposed internally and rotates with contacting to said intermediate transfer body.

6. The liquid type image forming apparatus according to claim 5, wherein said heating roller is a pressing roller for pressing a recording body, in which the visualized image is transferred from said intermediate transfer body, toward the intermediate transfer body.

7. The liquid type image forming apparatus according to claim 1, wherein said heating device heats said intermediate transfer body without contacting thereto.

8. The liquid type image forming apparatus according to claim 1, wherein said heating device makes a heating belt, which is moved endlessly, contact onto said intermediate transfer body while receiving a heat transfer from a heat source.

9. An image forming apparatus comprising:

an image carrier configured to carry an electrostatic latent image;

a developing device configured to develop the electrostatic latent image on the image carrier by using a liquid developer which is made of a carrier liquid and a toner containing at least resin and pigment;

a primary transfer device configured to transfer an image on the latent image carrier onto an intermediate transfer body;

a secondary transfer device configured to transfer the image on the intermediate transfer body onto a transfer member, wherein a device configured to eliminate a substance on an intermediate transfer body and having a form roller which has a surface roughness rougher than a surface of the intermediate transfer body is provided, and the substance on the intermediate transfer body is eliminated by rubbing the surface of said intermediate transfer body with the form roller.

10. The image forming apparatus according to claim 9, wherein said device configured to eliminate a substance on an intermediate transfer body is provided with a mechanism for cooling an intermediate transfer body for cooling at least the surface of said intermediate transfer body.

11. The image forming apparatus according to claim 9, wherein said device configured to eliminate a substance on an intermediate transfer body is provided with a heating mechanism of an intermediate transfer body for heating at least the surface of said intermediate transfer body.

12. The image forming apparatus according to claim 9, wherein said device configured to eliminate substance on an intermediate transfer body is provided with a solvent coating mechanism for dissolving a resin composing said toner and for adhering a solvent which does not dissolve the surface of said intermediate transfer body to the surface of the intermediate transfer body.

13. The image forming apparatus according to claim 9, wherein a cleaning member is disposed in a downstream of the device configured to eliminate a substance on an intermediate transfer body with respect to a rotation direction of said intermediate transfer body.

14. The image forming apparatus according to claim 9, wherein said liquid developer contains liquid type resin in a using environment.

15. The image forming apparatus according to claim 9, wherein a substance elimination on said intermediate transfer body by said device configured to eliminate a substance on an intermediate transfer body is carried out when an image is formed.

16. The image forming apparatus according to claim 9, wherein a substance elimination on said intermediate transfer body by said device configured to eliminate a substance on the intermediate transfer body is carried out when an image is not formed.

17. The image forming apparatus according to claim 16, wherein the substance elimination on said intermediate transfer body by said device configured to eliminate a substance on an intermediate transfer body is carried out at regular time intervals.

18. The image forming apparatus according to claim 16, wherein the substance elimination on the intermediate transfer body by said device configured to eliminate a substance on an intermediate transfer body is carried out at a predetermined number of prints.

19. The image forming apparatus according to claim 9, wherein a plurality of devices configured to eliminate a substance on an intermediate transfer body is combined to use.

20. An image forming apparatus, comprising:

an image carrier configured to carry an electrostatic latent image;

a developing device configured to develop the electrostatic latent image on the image carrier by using a liquid developer which is made of a carrier liquid and a toner at least containing resin and pigment;

a primary transfer device configured to transfer an image on the image carrier onto an intermediate transfer body; and a secondary transfer device configured to transfer the image on the intermediate transfer body to a transfer member, wherein a device configured to eliminate a substance on an intermediate transfer body and having a metal blade is provided, and the substance on the intermediate transfer body is eliminated by rubbing a surface of said intermediate transfer body with the metal blade.

21. An image forming apparatus comprising:

an image carrier configured to carry an electrostatic latent image;

a developing device configured to develop the electrostatic latent image on the image carrier by using a liquid developer which is made of a carrier liquid and a toner at least containing resin and pigment;

a primary transfer device configured to transfer an image on the image carrier onto an intermediate transfer body; and a secondary transfer device configured to transfer the image on the intermediate transfer body to a transfer member, wherein a device configured to eliminate a substance on an intermediate transfer body and having a substance eliminating member which is harder than the resin composing said toner and is softer than a surface of said intermediate transfer body is disposed, and the substance on the intermediate transfer body is eliminated by rubbing the surface of said transfer body with the substance eliminating member.

22. An image forming apparatus comprising:

an image carrier configured to carry an electrostatic latent image;

a developing device configured to develop the electrostatic latent image on the image carrier by using a liquid developer which is made of a carrier liquid and a toner at least containing resin and pigment;

a primary transfer device configured to transfer an image on the image carrier onto an intermediate transfer body; and a secondary transfer device configured to transfer the image on the intermediate transfer body to a transfer member, wherein a device configured to eliminate a substance on an intermediate transfer body and which sprays a high temperature vapor to said intermediate transfer body is provided.

23. A method for forming an image comprising:

primary transferring an image on an image carrier, which is developed by using a liquid developer containing a liquid type resin in a using environment, onto an intermediate transferring body;

secondary transferring an image on the intermediate transfer body onto a transfer member; and eliminating a substance on said intermediate transfer body.

* * * * *